US011682354B1

(12) United States Patent
Pyun et al.

(10) Patent No.: US 11,682,354 B1
(45) Date of Patent: Jun. 20, 2023

(54) DISPLAY DEVICE

(71) Applicant: Samsung Display Co., Ltd., Yongin-Si (KR)

(72) Inventors: Kihyun Pyun, Gwangmyeong-si (KR); Hyunjoo Seo, Changwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/981,225

(22) Filed: Nov. 4, 2022

(30) Foreign Application Priority Data

Mar. 23, 2022 (KR) ..... 10-2022-0036317

(51) Int. Cl.
*G09G 3/3258* (2016.01)

(52) U.S. Cl.
CPC ... *G09G 3/3258* (2013.01); *G09G 2300/0857* (2013.01)

(58) Field of Classification Search
CPC ..... G09G 2310/0275; G09G 3/006; G09G 3/2092; G09G 3/3685; G09G 5/003; G09G 2320/0233; G09G 2320/0223; G09G 2330/12; G09G 2330/04
See application file for complete search history.

(56) References Cited

U.S. PATENT DOCUMENTS 11,132,938 B2 9/2021 Nam
2010/0156879 A1* 6/2010 Hong ..... G09G 3/3648 345/213
2011/0234574 A1* 9/2011 Tanaka ..... G09G 3/2096 345/211
2015/0269898 A1* 9/2015 Xu ..... G09G 3/3611 345/93
2019/0340989 A1* 11/2019 Lee ..... G09G 3/3688
2020/0373834 A1 11/2020 Kwak et al.

FOREIGN PATENT DOCUMENTS

KR 10-0731730 B1 6/2007
KR 10-2020-0134058 A 12/2020
KR 10-2021-0018614 A 2/2021
KR 10-2021-0039880 A 4/2021

* cited by examiner

*Primary Examiner* — Dong Hui Liang
(74) *Attorney, Agent, or Firm* — Innovation Counsel LLP

(57) ABSTRACT

A display device is disclosed that includes a display panel, a first source circuit board, a second source circuit board, and a control circuit board. The first source circuit board is configured to output a first feedback voltage corresponding to a first driving voltage. The second source circuit board is configured to output a second feedback voltage corresponding to the second driving voltage. The control circuit board is configured to supply the first and second driving voltages to the first and second source circuit boards, respectively, and receive the first and second feedback voltages from the first and second source circuit boards, respectively. The control circuit board includes a comparison unit configured to compare the first and second feedback voltages with a preset reference voltage and generate a result signal in response to a comparison result, and a generation unit configured to generate a protection signal for activating a protection mode for protecting the display panel based on the result signal.

24 Claims, 15 Drawing Sheets

FIG. 8

| IP1 | IP2 | OP |
|---|---|---|
| 0 | 0 | 1 |
| 0 | 1 | 0 |
| 1 | 0 | 0 |
| 1 | 1 | 1 |

DISPLAY DEVICE

CROSS-REFERENCE TO RELATED APPLICATIONS

This U.S. non-provisional patent application claims priority under 35 U.S.C. § 119 of Korean Patent Application No. 10-2022-0036317, filed on Mar. 23, 2022, the entire contents of which are hereby incorporated by reference.

BACKGROUND

The present disclosure relates to a display device, and more particularly, to a display device capable of improving operational reliability.

Various display devices used in multimedia devices such as televisions, mobile phones, tablet computers, navigation devices, and game machines have been developed.

As the fields of use of such display devices are diversified, types of display panels for displaying images displayed on the display devices are also diversifying.

Recently, a display panel includes a light emitting display panel, and the light emitting display panel may include an organic light emitting display panel, an inorganic light emitting display panel, or a quantum dot light emitting display panel.

SUMMARY

The present disclosure may provide a display device capable of improving operational reliability by driving a display panel when a voltage for driving the display panel is stably supplied.

An embodiment of a display device includes: a display panel including a plurality of pixels for displaying an image; a first source circuit board configured to receive a first driving voltage, supply the first driving voltage to the display panel, and output a first feedback voltage corresponding to the first driving voltage; a second source circuit board configured to receive a second driving voltage, supply the second driving voltage to the display panel, and output a second feedback voltage corresponding to the second driving voltage; and a control circuit board configured to supply the first and second driving voltages to the first and second source circuit boards, respectively, and receive the first and second feedback voltages from the first and second source circuit boards, respectively, wherein the control circuit board includes: a comparison unit configured to compare the first and second feedback voltages with a preset reference voltage and generate a result signal in response to a comparison result; and a generation unit configured to generate a protection signal for activating a protection mode for protecting the display panel based on the result signal.

In an embodiment, the control circuit board may be electrically connected to the first source circuit board through a first connector, and electrically connected to the second source circuit board through a second connector.

In an embodiment, the first source circuit board may receive the first driving voltage through a first driving voltage wire, and provide the first feedback voltage to the control circuit board through a first feedback voltage wire connected to the first driving voltage wire, wherein the second source circuit board may receive the second driving voltage through a second driving voltage wire, and provide the second feedback voltage to the control circuit board through a second feedback voltage wire connected to the second driving voltage wire.

In an embodiment, the first connector may include a first transmission wire electrically connected to the first driving voltage wire and a first reception wire electrically connected to the first feedback voltage wire, and the second connector may include a second transmission wire electrically connected to the second driving voltage wire and a second reception wire electrically connected to the second feedback voltage wire, wherein the control circuit board may provide the first driving voltage to the first source circuit board through the first transmission wire and receive the first feedback voltage through the first reception wire, and provide the second driving voltage to the second source circuit board through the second transmission wire and receive the second feedback voltage through the second reception wire.

In an embodiment, the result signal may include a first sub result signal and a second sub result signal, wherein the comparison unit may include: a first comparator configured to generate the first sub result signal by comparing the first feedback voltage with the reference voltage; and a second comparator configured to generate the second sub result signal by comparing the second feedback voltage with the reference voltage.

In an embodiment, the first comparator may generate the first sub result signal by comparing the magnitude of the first feedback voltage with the magnitude of the reference voltage, and when the magnitude of the first feedback voltage is greater than the magnitude of the reference voltage, the first sub result signal may have a first polarity, and when the magnitude of the first feedback voltage is smaller than the magnitude of the reference voltage, the first sub result signal may have a second polarity opposite to the first polarity, wherein the second comparator may generate the second sub result signal by comparing the magnitude of the second feedback voltage with the magnitude of the reference voltage, and when the magnitude of the second feedback voltage is greater than the magnitude of the reference voltage, the second sub result signal may have the first polarity, and when the magnitude of the second feedback voltage is smaller than the magnitude of the reference voltage, the second sub result signal may have the second polarity.

In an embodiment, the control circuit board may further include: a first conversion unit configured to convert the first sub result signal into a first digital signal; and a second conversion unit configured to convert the second sub result signal to a second digital signal.

In an embodiment, the generation unit may include an arithmetic unit for generating a determination signal by performing an exclusive OR operation on the first digital signal received from the first conversion unit and the second digital signal received from the second conversion unit, wherein the generation unit may generate the protection signal based on the determination signal.

In an embodiment, the generation unit may further include a counter unit for receiving the determination signal from the arithmetic unit and receiving a section signal including information on a preset section from the outside and a count signal including information on a preset number, wherein the counter unit may generate the protection signal based on the determination signal, the section signal, and the count signal.

In an embodiment, the control circuit board may further include: a first flip-flop configured to receive the first digital signal from the first conversion unit and generate a first corrected digital signal by sampling the first digital signal according to a clock signal synchronized with an operation frame of the display panel; and a second flip-flop configured to receive the second digital signal from the second conversion unit and generate a second corrected digital signal by sampling the second digital signal according to the clock signal.

In an embodiment, the arithmetic unit may perform an exclusive OR operation on the first corrected digital signal received from the first flip-flop and the second corrected digital signal received from the second flip-flop to generate the determination signal.

In an embodiment, in the protection mode, the image may not be displayed on the display panel.

In an embodiment, in the protection mode, the first and second driving voltages may not be provided to the display panel.

In an embodiment, the control circuit board may further include a voltage generating block for generating the first driving voltage and the second driving voltage.

In an embodiment, each of the pixels may include: a light emitting device; and a pixel driving circuit configured to control an operation of the light emitting device based on a first power supply voltage and a second power supply voltage, wherein the control circuit board may supply the first and second power supply voltages to the pixel driving circuit.

In an embodiment, each of the first and second driving voltages may be the first power supply voltage.

In an embodiment, each of the first and second driving voltages may be the second power supply voltage.

An embodiment of a display device includes: a display panel including a plurality of pixels for displaying an image; a plurality of source circuit boards configured to respectively provide a plurality of driving voltages to the display panel, and respectively output a plurality of feedback voltages corresponding to the respective driving voltages; and a control circuit board configured to respectively supply the driving voltages to the source circuit boards and respectively receive the feedback voltages from the source circuit boards, wherein the control circuit board includes: a comparison unit configured to compare two feedback voltages among the feedback voltages with each other and generate a result signal in response to a comparison result; and a generation unit configured to generate a protection signal for activating a protection mode for protecting the display panel based on the result signal.

In an embodiment, the result signal may include a first sub result signal and a second sub result signal, wherein the comparison unit may include: a first comparator configured to generate the first sub result signal by comparing a magnitude of a first feedback voltage that is one of the two feedback voltages and a magnitude of a second feedback voltage that is the other one; and a second comparator configured to generate the second sub result signal, wherein the first comparator may generate the first sub result signal to have a first polarity when the magnitude of the first feedback voltage is greater than the magnitude of the second feedback voltage, and generate the first sub result signal to have a second polarity opposite to the first polarity when the magnitude of the first feedback voltage is smaller than the magnitude of the second feedback voltage, wherein the second comparator may generate the second sub result signal to have a second polarity when the magnitude of the first feedback voltage is greater than the magnitude of the second feedback voltage, and generate the second sub result signal to have the first polarity when the magnitude of the first feedback voltage is smaller than the magnitude of the second feedback voltage.

In an embodiment, the control circuit board may further include: a first conversion unit configured to convert the first sub result signal into a first digital signal; and a second conversion unit configured to convert the second sub result signal into a second digital signal.

In an embodiment, the generation unit may include an arithmetic unit for generating a determination signal by performing an exclusive OR operation on the first digital signal received from the first conversion unit and the second digital signal received from the second conversion unit, wherein the generation unit may generate the protection signal based on the determination signal.

In an embodiment, the generation unit may further include a counter unit for receiving the determination signal from the arithmetic unit and receiving a section signal including information on a preset section from the outside and a count signal including information on a preset number, wherein the counter unit may generate the protection signal based on the determination signal, the section signal, and the count signal.

In an embodiment, the control circuit board may further include: a first flip-flop configured to receive the first digital signal from the first conversion unit and generate a first corrected digital signal by sampling the first digital signal according to a clock signal synchronized with an operation frame of the display panel; and a second flip-flop configured to receive the second digital signal from the second conversion unit and generate a second corrected digital signal by sampling the second digital signal according to the clock signal.

In an embodiment, the arithmetic unit may perform an exclusive OR operation on the first corrected digital signal received from the first flip-flop and the second corrected digital signal received from the second flip-flop to generate the determination signal.

BRIEF DESCRIPTION OF THE FIGURES

The accompanying drawings are included to provide a further understanding of the inventive concept, and are incorporated in and constitute a part of this specification. The drawings illustrate embodiments of the inventive concept and, together with the description, serve to explain principles of the inventive concept. In the drawings:

FIG. 8 is a truth table for explaining the operation of an arithmetic unit according to an embodiment of the inventive concept;

DETAILED DESCRIPTION

Figure 1:
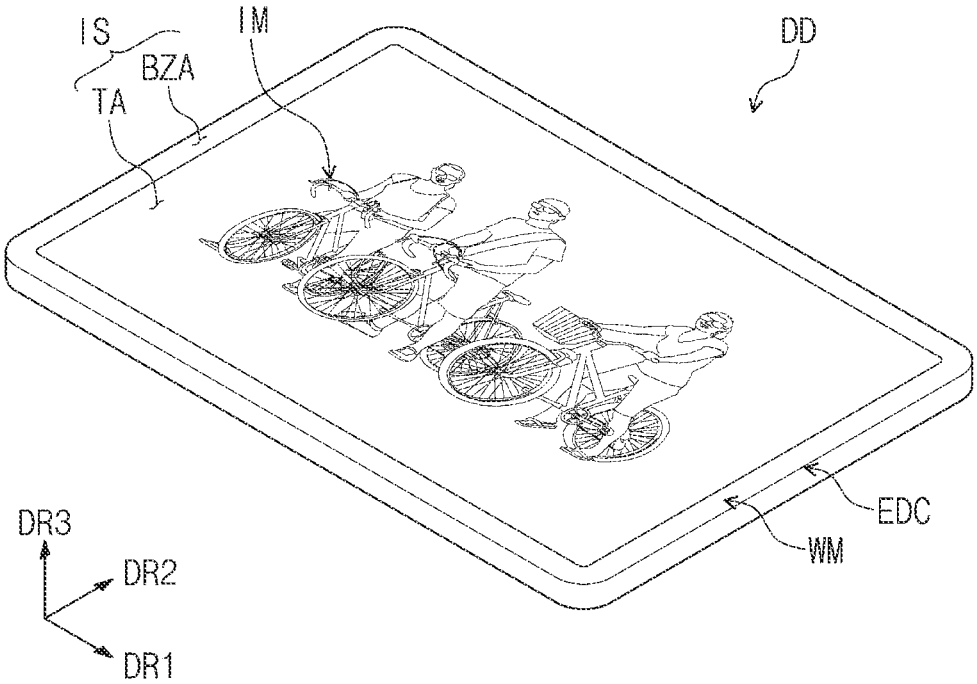
FIG. 1 is a perspective view of a display device according to an embodiment.

In this specification, when an element (or region, layer, part, etc.) is referred to as being "on", "connected to", or "coupled to" another element, it means that it may be directly placed on/connected to/coupled to other components, or a third component may be arranged between them.

Like reference numerals refer to like elements. Additionally, in the drawings, the thicknesses, proportions, and dimensions of components are exaggerated for effective description.

As used herein, the word "or" means logical "or" so that, unless the context indicates otherwise, the expression "A, B, or C" means "A and B and C," "A and B but not C," "A and C but not B," "B and C but not A," "A but not B and not C," "B but not A and not C," and "C but not A and not B."

It will be understood that the terms "first" and "second" are used herein to describe various components but these components should not be limited by these terms. The above terms are used only to distinguish one component from another. For example, a first component may be referred to as a second component and vice versa without departing from the scope of the inventive concept. The terms of a singular form may include plural forms unless otherwise specified.

In addition, terms such as "below", "the lower side", "on", and "the upper side" are used to describe a relationship of components shown in the drawing. The terms are described as a relative concept based on a direction shown in the drawing.

In various embodiments of the inventive concept, the term "include," "comprise," "including," or "comprising," specifies a property, a region, a fixed number, a step, a process, an element or a component but does not exclude other properties, regions, fixed numbers, steps, processes, elements or components.

Unless otherwise defined, all terms (including technical and scientific terms) used herein have the same meaning as commonly understood by one of ordinary skill in the art to which this inventive concept belongs. In addition, terms such as terms defined in commonly used dictionaries should be interpreted as having a meaning consistent with the meaning in the context of the related technology, and it should not be construed in an overly ideal or overly formal sense unless explicitly defined here.

Hereinafter, embodiments of the inventive concept will be described with reference to the drawings.

Figure 2:
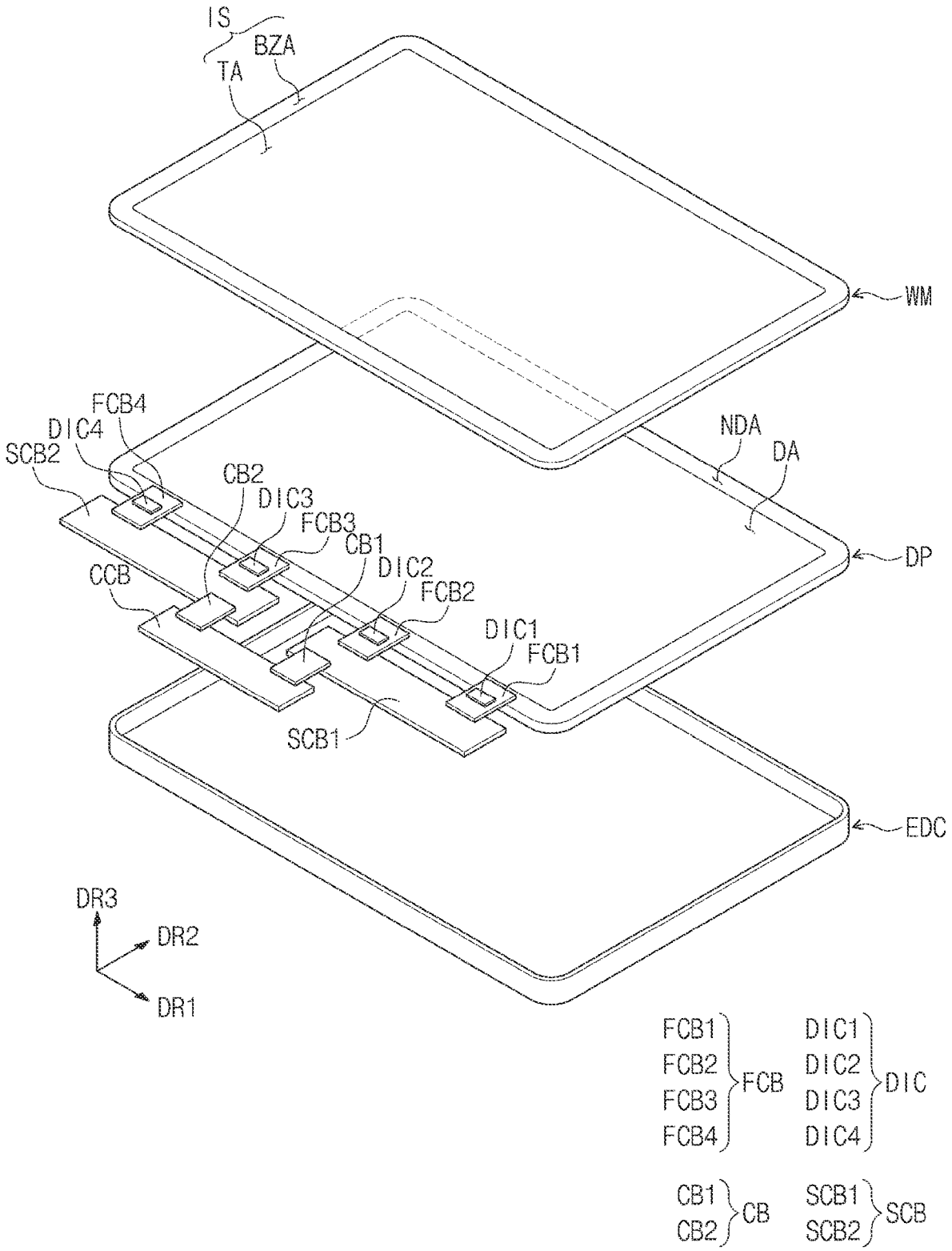
FIG. 2 is an exploded perspective view of a display device according to an embodiment.

FIG. 1 is a perspective view of a display device according to an embodiment, and FIG. 2 is an exploded perspective view of a display device according to an embodiment.

Referring to FIGS. 1 and 2, the display device DD may be a device that is activated according to an electrical signal. The display device DD according to the inventive concept may be a large-sized display device such as a television or a monitor, or a small/mid-sized display device such as a mobile phone, a tablet, a car navigation system, and a game machine. These are only presented by way of example, and may be employed in other electronic devices without departing from the concept of the inventive concept. Although the display device DD having the shape of a television is illustrated in FIG. 1, the embodiment of the inventive concept is not limited thereto.

The display device DD has a rectangular shape having a long side in a first direction DR1 and a short side in a second direction DR2 intersecting the first direction DR1. However, the shape of the display device DD is not limited thereto, and various shapes of the display device DD may be provided. The display device DD may display the image IM in the third direction DR3 on the display surface IS parallel to each of the first and second directions DR1 and DR2. The display surface IS on which the image IM is displayed may correspond to a front surface of the display device DD.

In this embodiment, the front (or upper surface) and the rear surface (or lower surface) of each member are defined based on the direction in which the image IM is displayed. The front and rear surfaces are opposing to each other in the third direction DR3, and a normal direction of each of the front and rear surfaces may be parallel to the third direction DR3.

The separation distance between the front and rear surfaces in the third direction DR3 may correspond to the thickness in the third direction DR3 of the display device DD. Moreover, the directions indicated by the first to third directions DR1, DR2, and DR3 are relative concepts and may be converted to other directions.

The display device DD may sense an external input applied from the outside. The external input may include various types of inputs provided from the outside of the display device DD. The display device DD according to an embodiment of the inventive concept may sense a user's external input applied from the outside. The user's external input may be any one or a combination of various types of external inputs, such as a part of the user's body, light, heat, or pressure. In addition, the display device DD may detect a user's external input applied to the side or rear surface of the display device DD according to the structure of the display device DD, and is not limited to any one embodiment.

The display device DD according to an embodiment of the inventive concept may sense inputs from an input device (e.g., a stylus pen, an active pen, a touch pen, an electronic pen, etc.) in addition to a user's external input.

The front surface of the display device DD may be divided into a transmission area TA and a bezel area BZA. The transmission area TA may be an area in which the image IM is displayed. The user visually recognizes the image IM through the transmission area TA. In this embodiment, the transmission area TA is illustrated in a rectangular shape with rounded vertices. However, this is illustrated by way of example, and the transmission area TA may have various shapes, and is not limited to any one embodiment.

The bezel area BZA is adjacent to the transmission area TA. The bezel area BZA may have a predetermined color. The bezel area BZA may surround the transmission area TA. Accordingly, the shape of the transmission area TA may be substantially defined by the bezel area BZA. However, this is illustrated as an example, and the bezel area BZA may be disposed adjacent to only one side of the transmission area TA, or may be omitted. The display device DD according to an embodiment of the inventive concept may include various embodiments, and is not limited to any one embodiment.

As illustrated in FIG. 2, the display device DD may include a window WM, a display panel DP, and an outer case EDC.

The window WM may be formed of a transparent material capable of emitting an image IM. For example, the window member WM may be made of glass, sapphire, plastic, or the like. The window WM is illustrated as a single layer, but the embodiment is not limited thereto and may include a plurality of layers.

Meanwhile, although not shown in the drawing, the bezel area BZA of the display device DD described above may be substantially provided as an area in which a material including a predetermined color is printed on one area of the window WM. As an example of the inventive concept, the window WM may include a light blocking pattern for defining the bezel area BZA. The light blocking pattern may be formed as a colored organic layer, for example, by a coating method.

The window WM may be coupled to the display panel DP through an adhesive film. As an example of the inventive concept, the adhesive film may include an optically clear adhesive (OCA) film. However, the adhesive film is not limited thereto, and may include a conventional adhesive or pressure-sensitive adhesive. For example, the adhesive film may include an optically clear resin (OCR) or a pressure sensitive adhesive (PSA) film.

An antireflection layer may be further disposed between the window WM and the display panel DP. The antireflection layer reduces the reflectance of external light incident from the upper side of the window WM. The antireflection layer according to an embodiment of the inventive concept may include a retarder and a polarizer. The retarder may be a film type or a liquid crystal coating type, and may include a 212 retarder or a 214 retarder. The polarizer may also be a film type or liquid crystal coating type. The film type may include a stretchable synthetic resin film, and the liquid crystal coating type may include liquid crystals arranged in a predetermined arrangement. The retarder and the polarizer may be implemented as one polarizing film.

As an example of the inventive concept, the antireflection layer may include color filters. The arrangement of the color filters may be determined in consideration of colors of light generated by the plurality of pixels PX11 to PXnm (refer to FIG. 3) included in the display panel DP. The antireflection layer may further include a light blocking pattern.

The display panel DP may include a display area DA displaying the image IM and a non-display area NDA adjacent to the display area DA. The display area DA may be an area from which the image IM provided from the display panel DP is emitted. The non-display area NDA may surround the display area DA. However, this is illustrated by way of example, and the non-display area NDA may be defined in various shapes and is not limited to any one embodiment. For example, the non-display area NDA may be provided adjacent to one side or both sides of the display area DA. According to an embodiment, the display area DA of the display panel DP may correspond to at least a portion of the transmission area TA, and the non-display area NDA may correspond to the bezel area BZA.

The display panel DP according to an embodiment of the inventive concept may be a light emitting display panel. For example, the display panel DP may be an organic light emitting display panel, an inorganic light emitting display panel, or a quantum dot light emitting display panel. In the organic light emitting display panel, the light emitting layer may include an organic light emitting material. The light emitting layer of the inorganic light emitting display panel may include an inorganic light emitting material. The light emitting layer of the quantum dot light emitting display panel may include quantum dot, quantum rod, and the like. Hereinafter, the display panel DP in the present embodiment will be described as an organic light emitting display panel.

As an example of the inventive concept, the display device DD may further include an input sensing layer for sensing an external input (e.g., a touch event, etc.). The input sensing layer may be directly disposed on the display panel DP. According to an embodiment of the inventive concept, the input sensing layer may be formed on the display panel DP by a continuous process. That is, when the input sensing layer is directly disposed on the display panel DP, the adhesive film may not be disposed between the input sensing layer and the display panel DP. However, the embodiment of the embodiment of the inventive concept is not limited thereto. An adhesive film may be disposed between the input sensing layer and the display panel DP. In this case, the input sensing layer is not manufactured by a continuous process with the display panel DP, and after manufactured through a process separate from that of the display panel DP, the input sensing layer may be fixed to the upper surface of the display panel DP by an adhesive film.

The display device DD may further include control circuit board CCB, a plurality of source circuit boards SCB, a plurality of connectors CB, a plurality of flexible circuit films FCB, and a plurality of driving chips DIC.

The source circuit boards SCB may be electrically connected to the display panel DP by being connected to the flexible circuit films FCB. The flexible circuit films FCB are connected to the display panel DP to electrically connect the display panel DP and the source circuit boards SCB. The control circuit board CCB may be connected to the connectors CB to be electrically connected to the source circuit boards SCB. The control circuit board CCB may be electrically connected to the display panel DP through the connectors CB, the source circuit board SCB, and the flexible circuit films FCB.

The control circuit board CCB and the source circuit boards SCB may include a plurality of driving elements. The driving elements may include a circuit unit for driving the display panel DP. Driving chips DIC may be mounted on the flexible circuit films FCB.

As an example of the inventive concept, the source circuit boards SCB may include a first source circuit board SCB1 and a second source circuit board SCB2. The connectors CB may include a first connector CB1 and a second connector CB2. The flexible circuit films FCB may include a first flexible circuit film FCB1, a second flexible circuit film FCB2, a third flexible circuit film FCB3, and a fourth flexible circuit film FCB4. The driving chips DIC may include a first driving chip DIC1, a second driving chip DIC2, a third driving chip DIC3, and a fourth driving chip DIC4.

The first source circuit board SCB1 and the second source circuit board SCB2 may be disposed to be spaced apart from each other in the first direction DR1. The control circuit board CCB may be electrically connected to the first source circuit board SCB1 through the first connector CB1. The control circuit board CCB may be electrically connected to the second source circuit board SCB2 through the second connector CB2.

The first and second flexible circuit films FCB1 and FCB2 are disposed to be spaced apart from each other in the first direction DR1, and are connected to the display panel DP to electrically connect the display panel DP to the first source circuit board SCB1. The first driving chip DIC1 may be mounted on the first flexible circuit film FCB1. The second driving chip DIC2 may be mounted on the second flexible circuit film FCB2.

The third and fourth flexible circuit films FCB3 and FCB4 are disposed to be spaced apart from each other in the first direction DR1, and are connected to the display panel DP to electrically connect the display panel DP to the second source circuit board SCB2. The third driving chip DIC3 may be mounted on the third flexible circuit film FCB3. The fourth driving chip DIC4 may be mounted on the fourth flexible circuit film FCB4.

However, embodiments of the inventive concept are not limited thereto. For example, the source circuit boards SCB may include at least three or more source circuit boards. In this case, the control circuit board CCB may be electrically connected to three or more source circuit boards. Also, the connectors CB may include at least three or more connectors. As an example of the inventive concept, when the connectors CB include four connectors, the control circuit board CCB may be electrically connected to each of the first and second source circuit boards SSB1 and SSB2 through two connectors.

The outer case EDC may be combined with the window WM to define the appearance of the display device DD. The outer case EDC protects the components accommodated in the outer case EDC by absorbing an external shock and preventing foreign substances/moisture from penetrating into the display panel DP. Meanwhile, as an example of the inventive concept, the outer case EDC may be provided in a form in which a plurality of accommodating members are combined.

The display device DD according to an embodiment may further include an electronic module including various functional modules for operating the display panel DP, a power supply module for supplying power required for the overall operation of the display device DD, and a bracket that is combined with the outer case EDC to divide the inner space of the display device DD.

Figure 3:
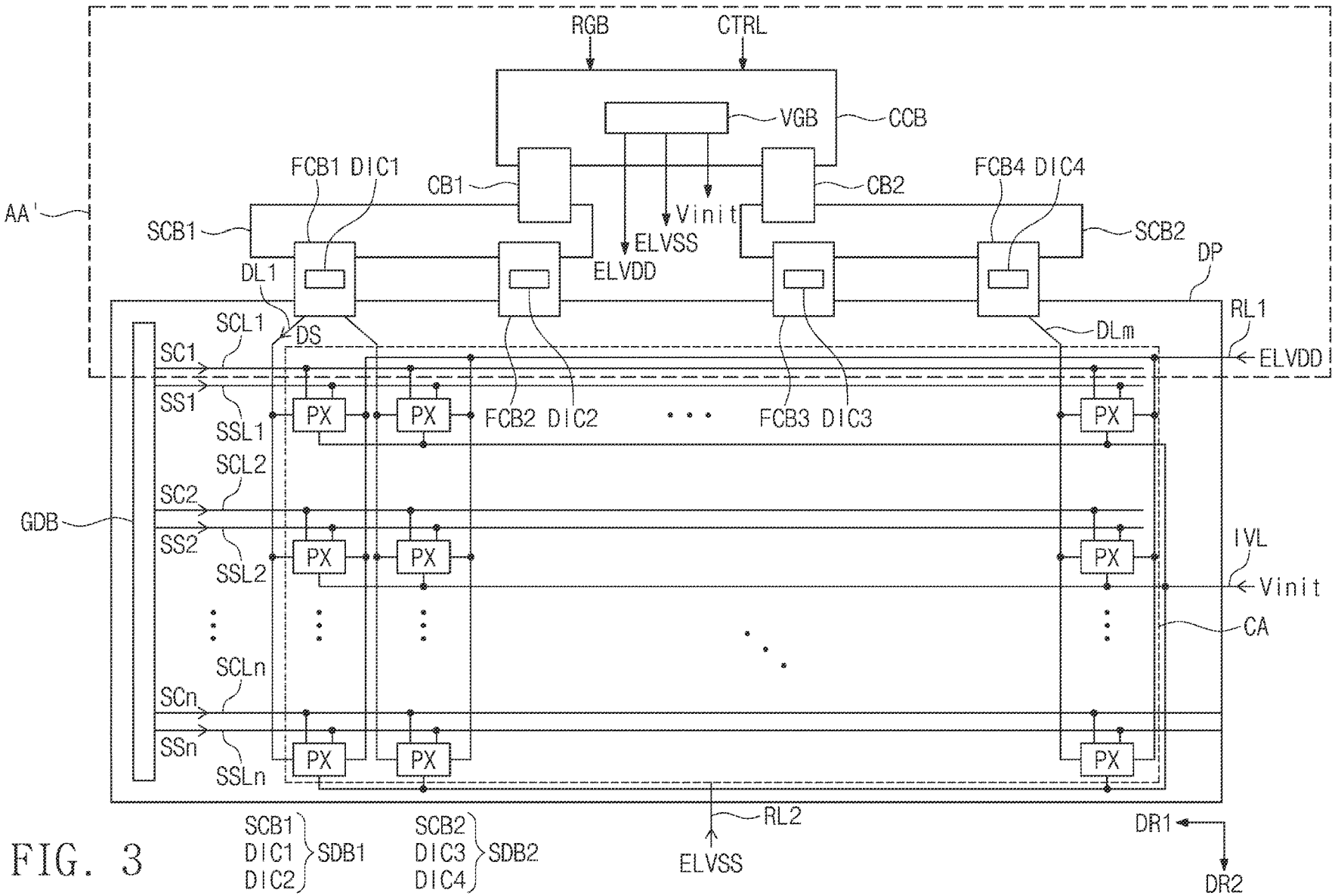
FIG. 3 is a block diagram of a display device according to an embodiment.

FIG. 3 is a block diagram of a display device according to an embodiment. Hereinafter, the same reference numerals are assigned to the same components as those described with reference to FIG. 2, and descriptions thereof will be omitted.

Referring to FIG. 3, the display device DD includes a display panel DP, a control circuit board CCB, a first source circuit board SCB1, a second source circuit board SCB2, a gate driving block GDB, a first connector CB1, a second connector CB2, first to fourth flexible circuit films FCB1 to FCB4, first to fourth driving chips DIC1 to DIC4, and a voltage generating block VGB.

As an example of the inventive concept, the control circuit board CCB receives the image signal RGB and the external control signal CTRL from the outside. The external control signal CTRL may include a vertical synchronization signal, a horizontal synchronization signal, and a main clock. The control circuit board CCB converts the data format of the image signal RGB to meet the interface specifications with the first and second source circuit boards SCB1 and SCB2 and the first to fourth driving chips DIC1 to DIC4 to generate image data. Hereinafter, for convenience of description, a configuration including the first source circuit board SCB1 and the first and second driving chips DIC1 and DIC2 will be referred to as a first source driving block SDB1. In addition, a configuration including the second source circuit board SCB2 and the third and fourth driving chips DIC3 and DIC4 is referred to as a second source driving block SDB2. The control circuit board CCB generates a control signal based on the external control signal CTRL. The control signal includes a source control signal and a gate control signal.

The control circuit board CCB provides image data and a source control signal to the first and second source driving blocks SDB1 and SDB2. The source control signal may include a horizontal start signal for starting the operation of the first and second source driving blocks SDB1 and SDB2. The first and second source driving blocks SDB1 and SDB2 generate a data signal DS based on image data in response to a source control signal. The first and second source driving blocks SDB1 and SDB2 output the data signal DS to a plurality of data lines DL1 to DLm to be described later. The data signal DS is an analog voltage corresponding to a grayscale value of image data.

The gate driving block GDB receives a gate control signal from the control circuit board CCB. The gate control signal may include a vertical start signal for starting the operation of the gate driving block GDB, a scan clock signal for determining output timing of the scan signals SC1 to SCn and the initialization signals SS1 to SSn, and the like. The gate driving block GDB generates scan signals SC1 to SCn and initialization signals SS1 to SSn based on the gate control signal. The gate driving block GDB sequentially outputs the scan signals SC1 to SCn to a plurality of scan lines SCL1 to SCLn, which will be described later, and sequentially outputs the initialization signals SS1 to SSn to a plurality of initialization lines SSL1 to SSLn, which will be described later.

As an example of the inventive concept, the control circuit board CCB may include a voltage generating block VGB. The voltage generating block VGB generates voltages necessary for the operation of the display panel DP.

As an example of the inventive concept, the voltage generating block VGB generates a first power supply voltage ELVDD, a second power supply voltage ELVSS, and an initialization voltage Vinit. The voltage generating block VGB may operate under the control of the control circuit board CCB. As an example of the inventive concept, the voltage level of the first power supply voltage ELVDD is greater than the voltage level of the second power supply voltage ELVSS. As an example of the inventive concept, the voltage level of the first power supply voltage ELVDD may be about 20 V to about 30 V. The voltage level of the initialization voltage Vinit is less than the voltage level of the second power supply voltage ELVSS.

As an example of the inventive concept, the display panel DP includes a plurality of scan lines SCL1 to SCLn, a plurality of initialization lines SSL1 to SSLn, a plurality of data lines DL1 to DLm, and a plurality of pixels PX. The scan lines SCL1 to SCLn and the initialization lines SSL1 to SSLn extend in a direction opposite to the first direction DR1 from the gate driving block GDB and are arranged to be spaced apart from each other in the second direction DR2. The data lines DL1 to DLm extend in the second direction DR2 from the first and second source driving blocks SDB1 and SDB2 and are arranged to be spaced apart from each other in the first direction DR1.

Each of the plurality of pixels PX is electrically connected to a corresponding one of the scan lines SCL1 to SCLn and a corresponding one of the initialization lines SSL1 to SSLn. Also, each of the plurality of pixels PX is electrically connected to a corresponding one of the data lines DL1 to DLm.

Each of the plurality of pixels PX is electrically connected to the first power line RL1, the second power line RL2, and the initialization power line IVL. The first power line RL1 receives the first power supply voltage ELVDD from the voltage generating block VGB. The second power line RL2 receives the second power supply voltage ELVSS from the voltage generating block VGB. The initialization power line IVL receives the initialization voltage Vinit from the voltage generating block VGB. However, as an example of the inventive concept, according to the configuration of the driving circuit of the pixels PX, a connection relationship between the pixels PX and the scan lines SCL1 to SCLn, the initialization lines SSL1 to SSLn, and the data lines DL1 to DLm may be changed.

The pixels PX may include a plurality of groups including organic light emitting diodes that generate light of different colors. For example, the pixels PX may include red pixels generating red color light, green pixels generating green color light, and blue pixels generating blue color light. The organic light emitting diode of the red pixel, the organic light emitting diode of the green pixel, and the organic light emitting diode of the blue pixel may include light emitting layers of different materials. As an example of the inventive concept, each of the pixels PX may include white pixels generating white color light. In this case, the antireflection layer included in the display device DD may further include color filters. The display device DD may display an image IM (refer to FIG. 1) based on the light emitted by the white color light passing through the color filters. However, as an example of the inventive concept, the pixels PX may be formed of blue pixels that generate blue color light. In this case, the display device DD may display the image IM based on the light emitted by the blue color light passing through the color filters. As an example of the inventive concept, when blue color light passes through color filters, the passing light may have a color of a wavelength different from that of the blue color light. As an example of the inventive concept, color filters may include quantum dots. Quantum dots are particles that may control the wavelength of emitted light by converting the wavelength of incident light. The quantum dot may control the wavelength of light emitted according to the particle size, and accordingly, the quantum dot may emit light having a red color light, a green color light, and a blue color light.

The organic light emitting diode included in each pixel PX may include a cathode CA. The cathode CA may be electrically connected to the second power line RL2 to receive the second power supply voltage ELVSS from the voltage generating block VGB. Alternatively, the plurality of cathodes CA included in the pixels PX may be integrally formed with each other to form a common cathode. As an example of the inventive concept, the common cathode may be formed to overlap two or more pixels.

Figure 4:
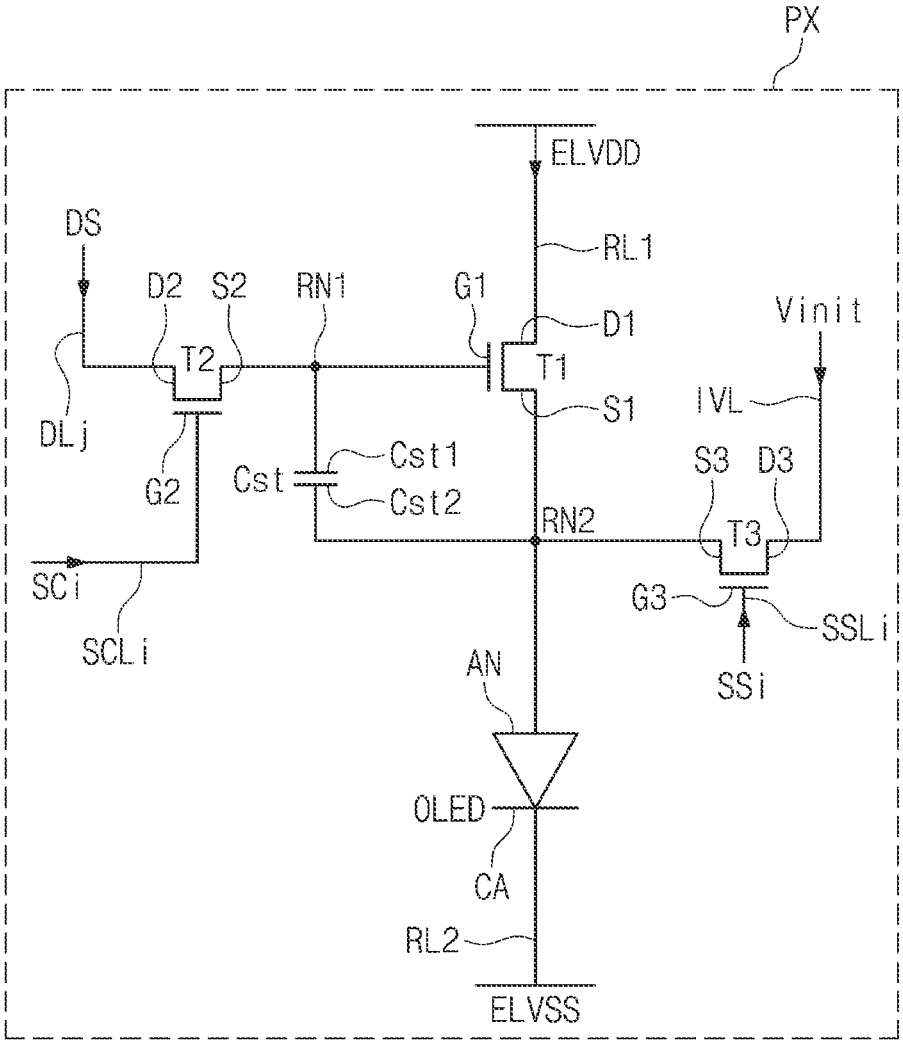
FIG. 4 is an equivalent circuit diagram of a pixel according to an embodiment of the inventive concept.

FIG. 4 is an equivalent circuit diagram of a pixel according to an embodiment of the inventive concept.

Referring to FIG. 4, a pixel PX connected to an i-th scan line SCLi among scan lines SCL1 to SCLn and an i-th initialization line SSLi among initialization lines SSL1 to SSLn, and connected to a j-th data line DLj among the data lines DL1 to DLm is illustrated as an example.

As an example of the inventive concept, the pixel PX may include first to third transistors T1, T2, and T3, a capacitor Cst, and a light emitting diode OLED. In this embodiment, each of the first to third transistors T1, T2, and T3 is described as an N-type transistor. However, the embodiment of the embodiment of the inventive concept is not limited thereto, and the first to third transistors T1, T2, and T3 may be implemented as either a P-type transistor or an N-type transistor. In this specification, "a transistor is connected to the signal line" means "one electrode of the source electrode, the drain electrode, and the gate electrode of the transistor has an integral shape with the signal line or is connected through a connection electrode". In addition, "a transistor is electrically connected to another transistor" means "one electrode among the source electrode, drain electrode, and gate electrode of a transistor has an integral shape with any one electrode among the source electrode, drain electrode, and gate electrode of another transistor or is connected through a connection electrode".

In this embodiment, the first transistor T1 may be a driving transistor, and the second transistor T2 may be a switching transistor. The third transistor T3 may be an initialization transistor. Hereinafter, the first to third transistors T1 to T3 each include a first electrode, a second electrode, and a control electrode, and the first electrode is referred to as the source electrode, the second electrode is referred to as the drain electrode, and the control electrode is referred to as the gate electrode.

The first transistor T1 is connected between the first power line RL1 and the light emitting diode OLED. The source electrode S1 of the first transistor T1 is electrically connected to the anode AN of the light emitting diode OLED. The drain electrode D1 of the first transistor T1 is electrically connected to the first power line RL1. The gate electrode G1 of the first transistor T1 is electrically connected to the first reference node RN1. The first reference node RN1 may be a node electrically connected to the source electrode S2 of the second transistor T2. As an example of the inventive concept, the first power supply voltage ELVDD may be transmitted to the drain electrode D1 of the first transistor T1 through the first power line RL1.

The second transistor T2 is connected between the j-th data line DLj and the gate electrode G1 of the first transistor T1. The source electrode S2 of the second transistor T2 is electrically connected to the gate electrode G1 of the first transistor T1. The drain electrode D2 of the second transistor T2 is electrically connected to the j-th data line DLj. The gate electrode G2 of the second transistor T2 is electrically connected to the i-th scan line SCLi. As an example of the inventive concept, the i-th scan signal SCi may be transmitted to the gate electrode G2 of the second transistor T2 through the i-th scan line SCLi. The data signal DS may be transferred to the drain electrode D2 of the second transistor T2 through the j-th data line DLj.

The third transistor T3 is connected between the second reference node RN2 and the initialization power line IVL. The source electrode S3 of the third transistor T3 is electrically connected to the second reference node RN2. The second reference node RN2 may be a node electrically connected to the source electrode S1 of the first transistor T1. Also, the second reference node RN2 may be a node electrically connected to the anode AN of the light emitting diode OLED. The drain electrode D3 of the third transistor T3 is electrically connected to the initialization power line IVL. The gate electrode G3 of the third transistor T3 is electrically connected to the i-th initialization line SSLi. As an example of the inventive concept, the i-th initialization signal SSi may be transmitted to the gate electrode G3 of the third transistor T3 through the i-th initialization line SSLi. The initialization voltage Vinit may be transmitted to the drain electrode D3 of the third transistor T3 through the initialization power line IVL.

The light emitting diode OLED is connected between the second reference node RN2 and the second power line RL2. The anode AN of the light emitting diode OLED is electrically connected to the second reference node RN2. The cathode CA of the light emitting diode OLED is electrically connected to the second power line RL2.

The capacitor Cst is connected between the first reference node RN1 and the second reference node RN2. The first electrode Cst1 of the capacitor Cst may be electrically connected to the first reference node RN1, and the second electrode Cst2 of the capacitor Cst may be electrically connected to the second reference node RN2.

Referring to FIG. 3, the gate driving block GDB sequentially transmits scan signals SC1 to SCn and initialization signals SS1 to SSn to the display panel DP. Each of the scan signals SC1 to SCn and the initialization signals SS1 to SSn may have a high level during some sections and a low level during some sections. At this time, the N-type transistors are turned on when the corresponding signal has a high level, and the P-type transistors are turned on when the corresponding signal has a low level. Hereinafter, the pixel PX including the first to third N-type transistors T1, T2, and T3 illustrated in FIG. 4 will be described as a reference.

When the i-th initialization signal SSi has a high level, the third transistor T3 is turned on. When the third transistor T3 is turned on, the initialization voltage Vinit is transmitted to the second reference node RN2 through the third transistor T3. Therefore, the second reference node RN2 is initialized with an initialization voltage Vinit, and the source electrode S1 of the first transistor T1 and the anode AN of the light emitting diode OLED electrically connected to the second reference node RN2 are also initialized to the initialization voltage Vinit.

When the i-th scan signal SCi has a high level, the second transistor T2 is turned on. When the second transistor T2 is turned on, the data signal DS is transmitted to the first reference node RN1 through the second transistor T2. Accordingly, the data signal DS is also applied to the gate electrode G1 of the first transistor T1 and the first electrode Cst1 of the capacitor Cst electrically connected to the first reference node RN1. When the data signal DS is applied to the gate electrode G1 of the first transistor T1, the first transistor T1 may be turned on.

As an example of the inventive concept, a section in which the i-th initialization signal SSi has a high level and a section in which the i-th scan signal SCi has a high level may overlap. In this case, the data signal DS and the initialization voltage Vinit may be applied to both ends of the capacitor Cst, and charges corresponding to the voltage difference DS-Vinit may be stored in the capacitor Cst.

Meanwhile, a second power supply voltage ELVSS is applied to the cathode CA of the light emitting diode OLED. Therefore, as the i-th initialization signal SSi has a high level, when the initialization voltage Vinit having a voltage level lower than the voltage level of the second power supply voltage ELVSS is applied to the anode AN of the light emitting diode OLED, no current flows through the light emitting diode OLED.

When the i-th scan signal SCi has a low level, the second transistor T2 is turned off. When the i-th initialization signal SSi has a low level, the third transistor T3 is turned off. As an example of the inventive concept, a section in which the i-th scan signal SCi has a low level and a section in which the i-th initialization signal SSi has a low level may overlap.

Even when the i-th scan signal SCi has a low level and the second transistor T2 is turned off, the first transistor T1 maintains a turned-on state by the charge stored in the capacitor Cst. Accordingly, a driving current flows through the first transistor T1. The voltage level of the anode AN of the light emitting diode OLED may gradually increase in the internal capacitor by the driving current flowing through the first transistor T1. When the voltage level of the anode AN is higher than the voltage level of the cathode CA, a driving current flows to the light emitting diode OLED, and the light emitting diode OLED emits light. At this time, even if the voltage level of the second reference node RN2 increases, the voltage level of the first reference node RN1 may also increase due to a coupling effect of the capacitor Cst, so that the level of the driving current flowing through the first transistor T1 may be maintained.

As an example of the inventive concept, referring to FIGS. 3 and 4, a voltage generating block VGB included in the control circuit board CCB provides a first power supply voltage ELVDD, a second power supply voltage ELVSS, and an initialization voltage Vinit to each pixel PX included in the display panel DP through the first connector CB1 and the first source driving block SDB1. In addition, the voltage generating block VGB included in the control circuit board CCB provides a first power supply voltage ELVDD, a second power supply voltage ELVSS, and an initialization voltage Vinit to each pixel PX included in the display panel DP through the second connector CB2 and the second source driving block SDB2.

Figure 5:
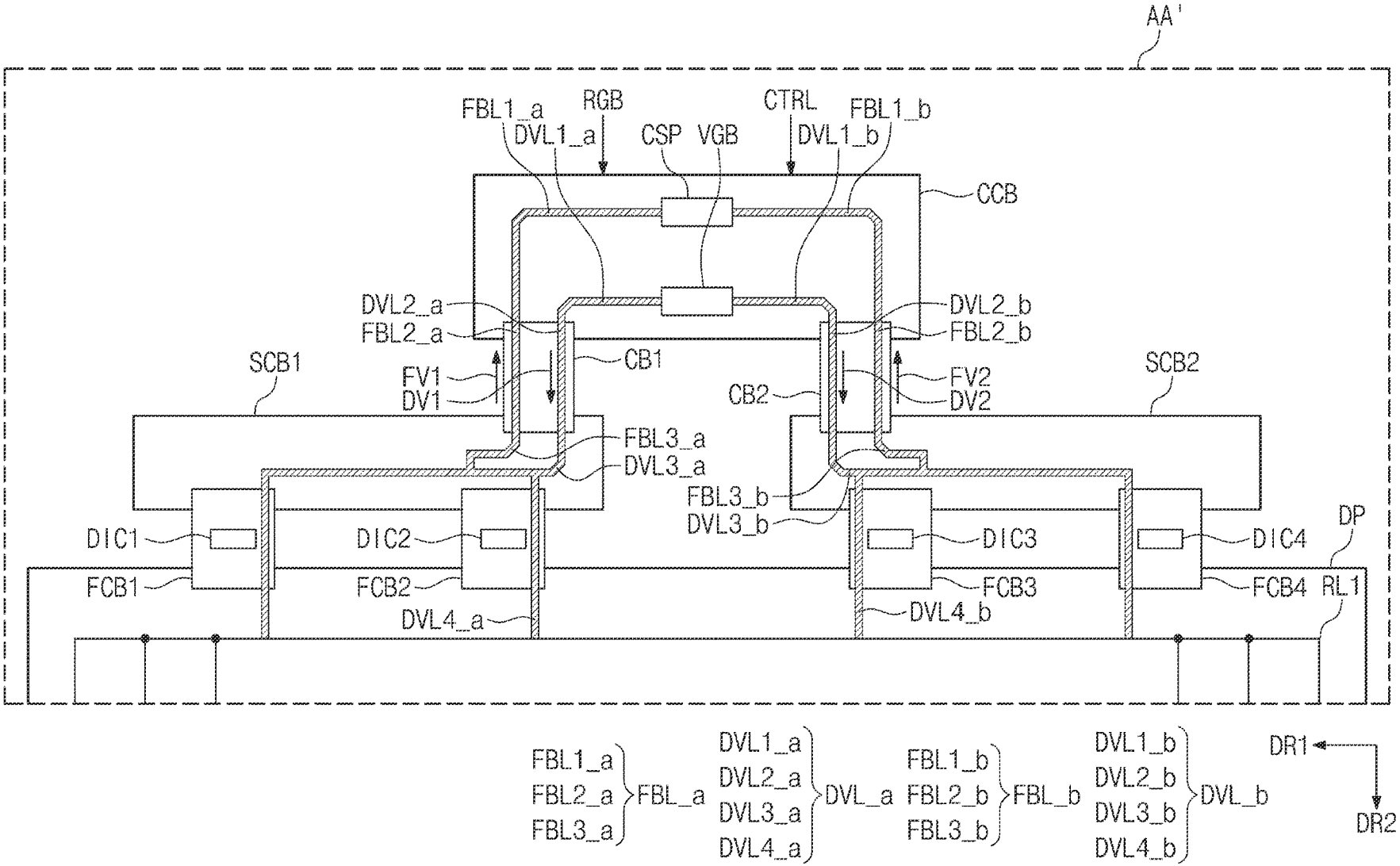
FIG. 5 is an enlarged view of the display device in the area AA' shown in FIG. 3.

FIG. 5 is an enlarged view of the display device in the area AA' shown in FIG. 3. Hereinafter, the same reference numerals are assigned to the same components as those described with reference to FIGS. 3 and 4, and descriptions thereof will be omitted.

Referring to FIG. 5, as an example of the inventive concept, the control circuit board CCB includes a first connection wire DVL1_*a*, a second connection wire DVL1_*b*, a third connection wire FBL1_*a*, and a fourth connection wire FBL1_*b*. The first connector CB1 includes a first transmission wire DVL2_*a* electrically connected to the first connection wire DVL1_*a* and a first reception wire FBL2_*a* electrically connected to the third connection wire FBL1_*a*. The second connector CB2 includes a second transmission wire DVL2_*b* electrically connected to the second connection wire DVL1_*b* and a second reception wire FBL2_*b* electrically connected to the fourth connection wire FBL1_*b*.

The first source circuit board SCB1 includes a first driving voltage wire DVL3_*a* electrically connected to the first transmission wire DVL2_*a* and a first feedback voltage wire FBL3_*a* electrically connected to the first reception wire FBL2_*a*. As an example of the inventive concept, the first feedback voltage wire FBL3_*a* may be electrically connected to the first driving voltage wire DVL3_*a*.

The second source circuit board SCB2 includes a second driving voltage wire DVL3_*b* electrically connected to the second transmission wire DVL2_*b* and a second feedback voltage wire FBL3_*b* electrically connected to the second reception wire FBL2_*b*. As an example of the inventive concept, the second feedback voltage wire FBL3_*b* may be electrically connected to the second driving voltage wire DVL3_*b*.

The display panel DP includes the third driving voltage wire DVL4_*a* electrically connected to the first driving voltage wire DVL3_*a* and the fourth driving voltage wire DVL4_*b* electrically connected to the second driving voltage wire DVL3_*b*.

As an example of the inventive concept, each of the first to fourth connection wires DVL1_*a*, DVL1_*b*, FBL1_*a*, and FBL1_*b* is illustrated in a shape extending in the first direction DR1 and the second direction DR2, but the embodiment of the embodiment of the inventive concept is not limited thereto. A shape of each of the first to fourth connection wires DVL1_*a*, DVL1_*b*, FBL1_*a*, and FBL1_*b* may be formed in a direction crossing the first direction DR1 and the second direction DR2 depending on the positions of the first and second connectors CB1 and CB2 connected to the control circuit board CCB.

As an example of the inventive concept, it is shown that the first transmission wire DLV2_*a* and the first reception wire FBL2_a included in the first connector CB1 are spaced apart in the first direction DR1 and are disposed at both ends of the first connector CB1, but the embodiment of the embodiment of the inventive concept is not limited thereto. The first transmission wire DVL2_a and the first reception wire FBL2_a may be disposed adjacent to each other in the first connector CB1.

As an example of the inventive concept, it is shown that the second transmission wire DLV2_b and the second reception wire FBL2_b included in the second connector CB2 are spaced apart in the first direction DR1 and are disposed at both ends of the second connector CB2, but the embodiment of the embodiment of the inventive concept is not limited thereto. The second transmission wire DVL2_b and the second reception wire FBL2_b may be disposed adjacent to each other in the second connector CB2.

As an example of the inventive concept, each of the first and second driving voltage wires DVL3_a and DVL3_b and the first and second feedback voltage wires FBL3_a and FBL3_b is illustrated as extending in the first direction DR1 and the second direction DR2, but the embodiment of the embodiment of the inventive concept is not limited thereto. The shape of each of the first and second driving voltage wires DVL3_a and DVL3_b and the first and second feedback voltage wires FBL3_a and FBL3_b may be formed in a direction crossing the first direction DR1 and the second direction DR2 according to the positions of the first to fourth flexible circuit films FCB1 to FCB4 electrically connected to each of the first and second source circuit boards SCB1 and SCB2.

As an example of the inventive concept, the third driving voltage wire DVL4_a and the fourth driving voltage wire DVL4_b may be electrically connected to the first power line RL1.

As an example of the inventive concept, the voltage generating block VGB provides a first power supply voltage ELVDD or a second power supply voltage ELVSS to the first and second connection wires DVL1_a and DVL2_b. Hereinafter, the first power supply voltage ELVDD or the second power supply voltage ELVSS provided by the voltage generating block VGB to the first connection wire DVL1_a is referred to as a first driving voltage DV1. In addition, the first power supply voltage ELVDD or the second power supply voltage ELVSS provided by the voltage generating block VGB to the second connection wire DVL1_b is referred to as a second driving voltage DV2. As an example of the inventive concept, when the first and second driving voltages DV1 and DV2 are the first power supply voltage ELVDD, the control circuit board CCB further includes a separate connection wire for receiving the second power supply voltage ELVSS in addition to the first and second connection wires DVL1_a and DVL1_b. Also, when the first and second driving voltages DV1 and DV2 are the second power supply voltage ELVSS, the control circuit board CCB further includes a separate connection wire for receiving the first power supply voltage ELVDD in addition to the first and second connection wires DVL1_a and DVL1_b. Hereinafter, for convenience of description, it will be described that the first and second driving voltages DV1 and DV2 are the first power supply voltage ELVDD.

The first driving voltage DV1 provided to the first connection wire DVL1_a is provided to the first source circuit board SCB1 through the first transmission wire DVL2_a and the first driving voltage wire DVL3_a. Also, the first driving voltage DV1 is provided to the first power line RL1 of the display panel DP through the third driving voltage wire DVL4_a electrically connected to the first driving voltage wire DVL3_a included in the first source circuit board SCB1.

The second driving voltage DV2 provided to the second connection wire DVL1_b is provided to the second source circuit board SCB2 through the second transmission wire DVL2_b and the second driving voltage wire DVL3_b. Also, the second driving voltage DV2 is provided to the first power line RL1 of the display panel DP through the fourth driving voltage wire DVL4_b electrically connected to the second driving voltage wire DVL3_b included in the second source circuit board SCB2.

The first driving voltage DV1 provided to the first source circuit board SCB1 and the second driving voltage DV2 provided to the second source circuit board SCB2 are provided to the first power line RL1 of the display panel DP through the third and fourth driving voltage wires DVL4_a and DVL4_b. The first and second driving voltages DV1 and DV2 are provided to each of the pixels PX included in the display panel DP through the first power line RL1.

In this case, when the connection state between the control circuit board CCB and the first connector CB1 is poor or the connection state between the first connector CB1 and the first source circuit board SCB1 is poor, the first driving voltage DV1 provided from the voltage generating block VGB to the first connection wire DVL1_a may not be transmitted to the first source circuit board SCB1. In addition, when the connection state between the control circuit board CCB and the second connector CB2 is poor or the connection state between the second connector CB2 and the second source circuit board SCB2 is poor, the second driving voltage DV2 provided from the voltage generating block VGB to the second connection wire DVL1_b may not be transmitted to the second source circuit board SCB2. In this case, in order to display an image IM (refer to FIG. 1) on the display panel DP, by using any one of first and second driving voltages DV1 and DV2 provided to any one of the first and second source circuit boards SCB1 and SCB2 that are normally connected to the control circuit board CCB, a first power supply voltage ELVDD is required to be provided to the first power line RL1. When providing the first power supply voltage ELVDD to the first power line RL1 through any one of the first and second source circuit boards SCB1 and SCB2, a current greater than the rated current of the display panel DP flows in a portion of the first power line RL1 corresponding to the source circuit board providing the first power supply voltage ELVDD. Accordingly, the display panel DP may be damaged.

As an example of the inventive concept, the control circuit board CCB further includes a comparison unit CSP. The first feedback voltage FV1 corresponding to the first driving voltage DV1 is provided to the comparison unit CSP through the first feedback voltage wire FBL3_a. Since the first feedback voltage wire FBL3_a is electrically connected to the first driving voltage wire DVL3_a, the first feedback voltage FV1 may be a voltage corresponding to the first driving voltage DV1 provided to the first source circuit board SCB1 through the first connection wire DVL1_a and the first transmission wire DVL2_a. As an example of the inventive concept, the magnitude of the first feedback voltage FV1 when the connection state between the control circuit board CCB and the first connector CB1 is bad or the connection state between the first connector CB1 and the first source circuit board SCB1 is bad is smaller than the magnitude of the first feedback voltage FV1 when the connection state between the control circuit board CCB, the first connector CB1 and the first source circuit board SCB1 is normal.

The second feedback voltage FV2 corresponding to the second driving voltage DV2 is provided to the comparison unit CSP through the second feedback voltage wire FBL3_*b*. Since the second feedback voltage wire FBL3_*b* is electrically connected to the second driving voltage wire DVL3_*b*, the second feedback voltage FV2 may be a voltage corresponding to the second driving voltage DV2 provided to the second source circuit board SCB2 through the second connection wire DVL1_*b* and the second transmission wire DVL2_*b*. As an example of the inventive concept, the magnitude of the second feedback voltage FV2 when the connection state between the control circuit board CCB and the second connector CB2 is bad or the connection state between the second connector CB2 and the second source circuit board SCB2 is bad is smaller than the magnitude of the second feedback voltage FV2 when the connection state between the control circuit board CCB, the second connector CB2 and the second source circuit board SCB2 is normal.

The comparison unit CSP may check a connection state between the control circuit board CCB, the first connector CB1, and the first source circuit board SCB1 and a connection state between the control circuit board CCB, the second connector CB2, and the second source circuit board SCB2 based on the received first and second feedback voltages FV1 and FV2. The configuration and operation of the comparison unit CSP and the configuration and operation of the control circuit board CCB based thereon will be described later with reference to FIGS. 6A to 10.

Figure 6A:
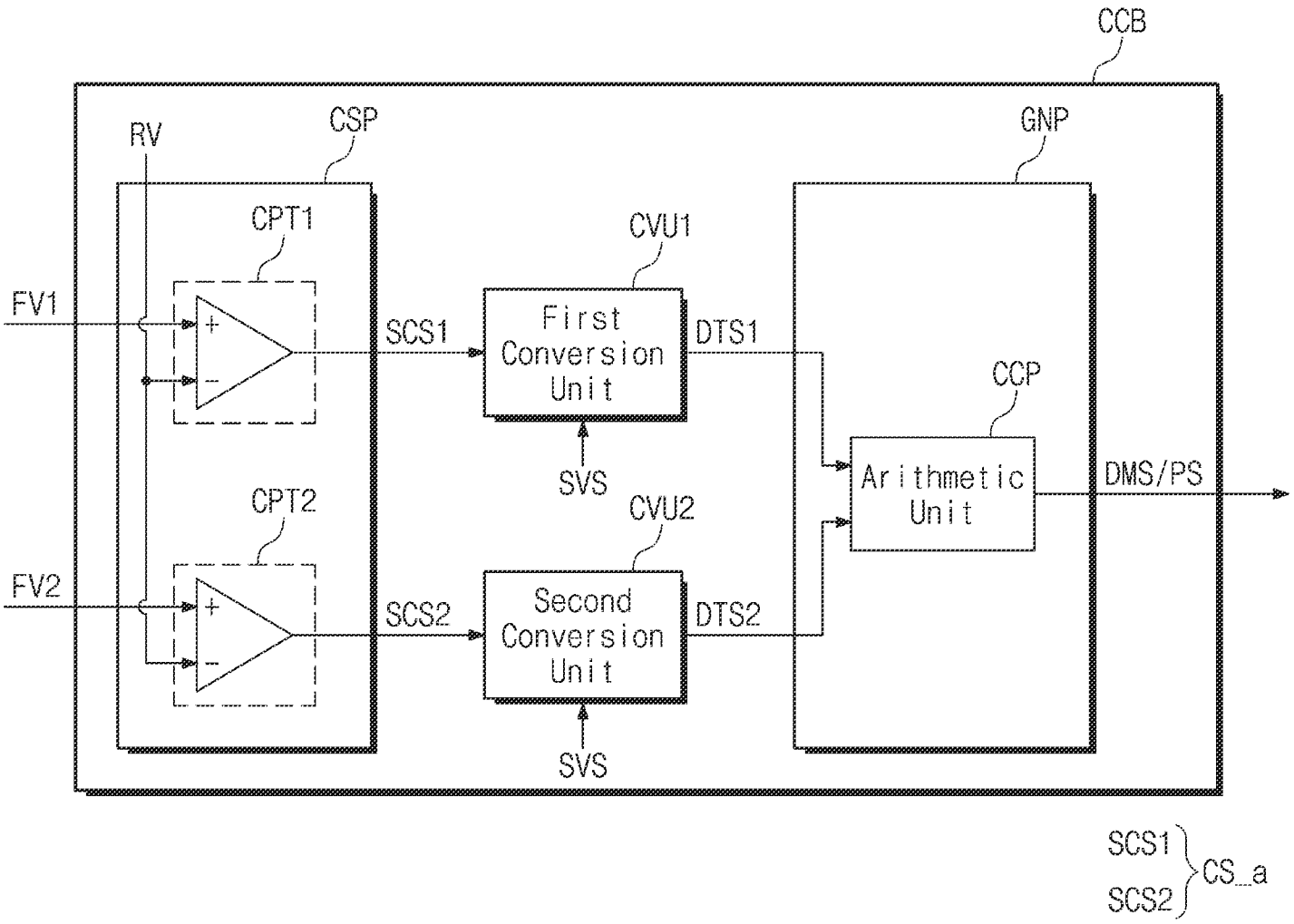
FIGS. 6A, 6B, and 6C are block diagrams for explaining the structure of a circuit part of a control circuit board according to embodiments of the inventive concept.
Figure 6B:
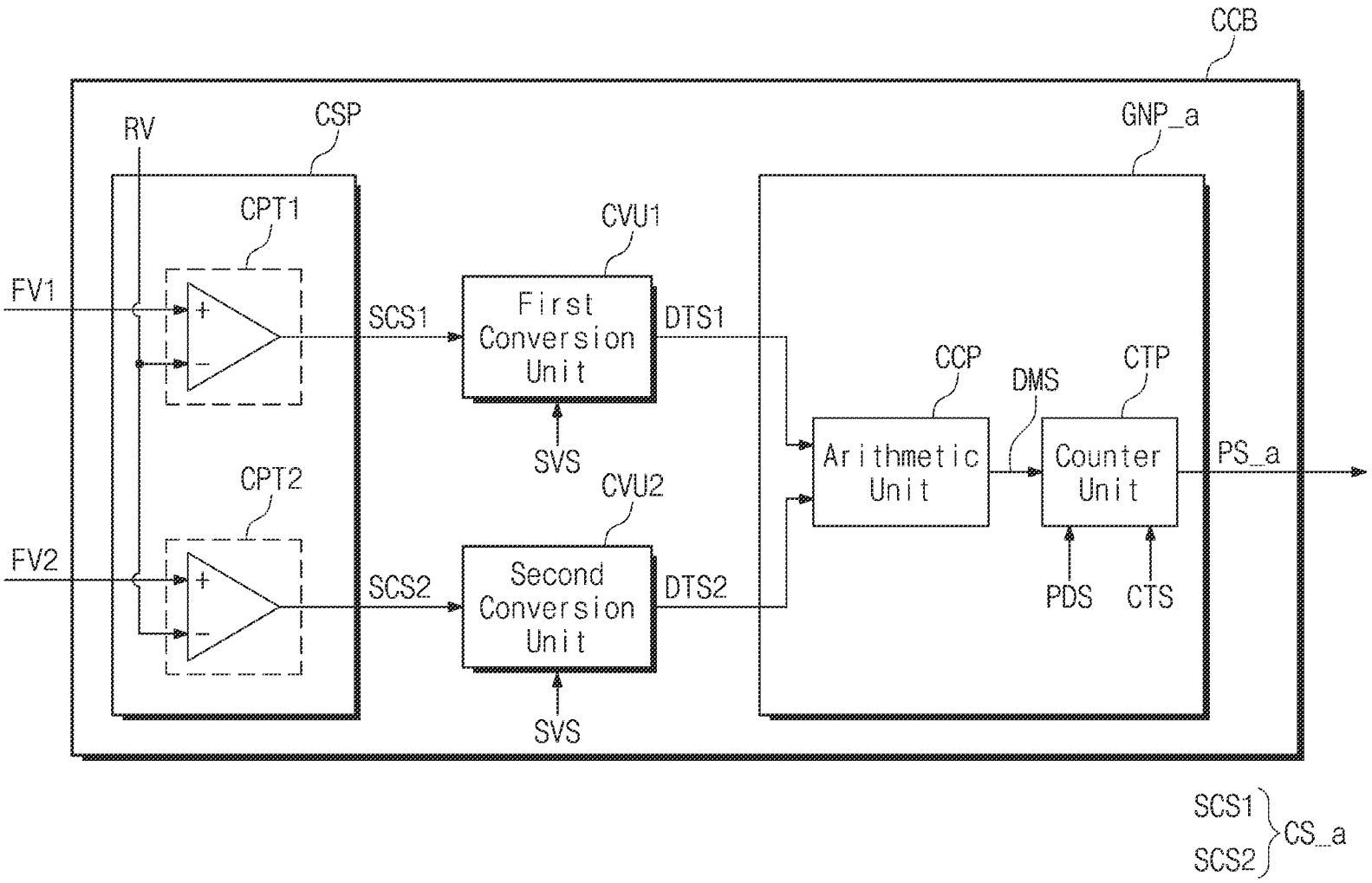
Figure 6C:
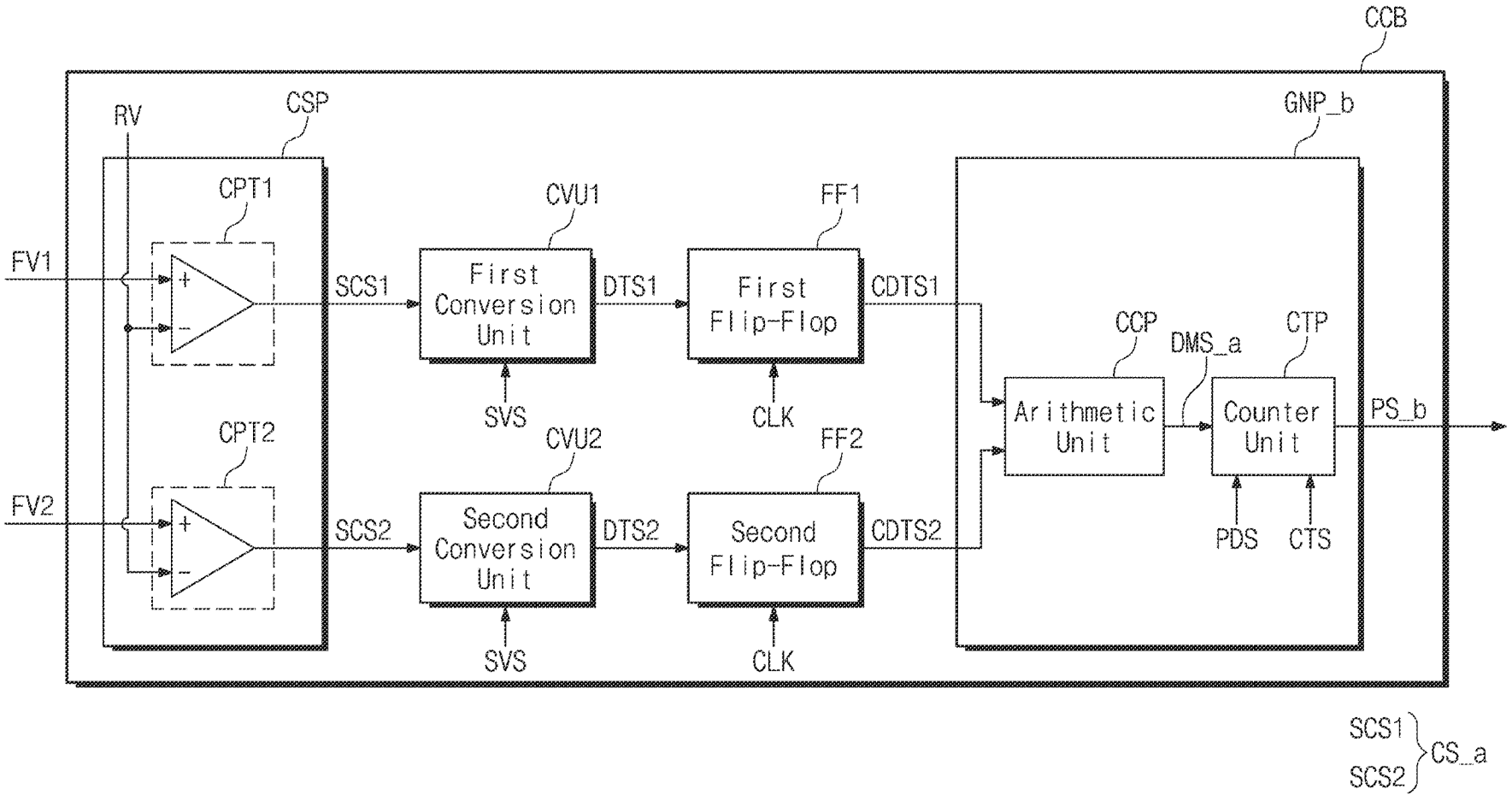
Figure 7A:
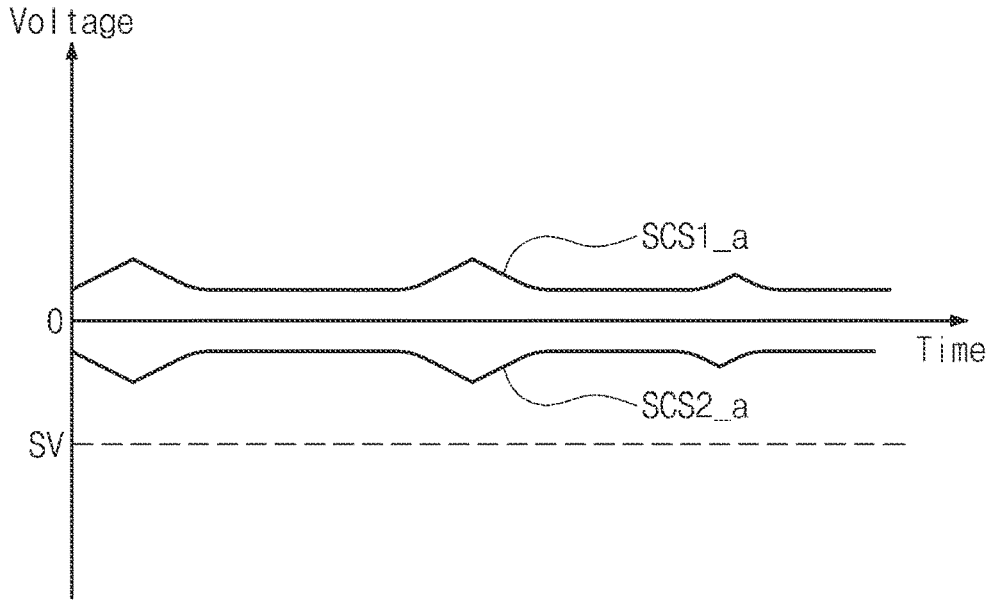
FIGS. 7A, 7B, and 7C are graphs for explaining an operation of a comparison unit according to embodiments of the inventive concept.
Figure 7B:
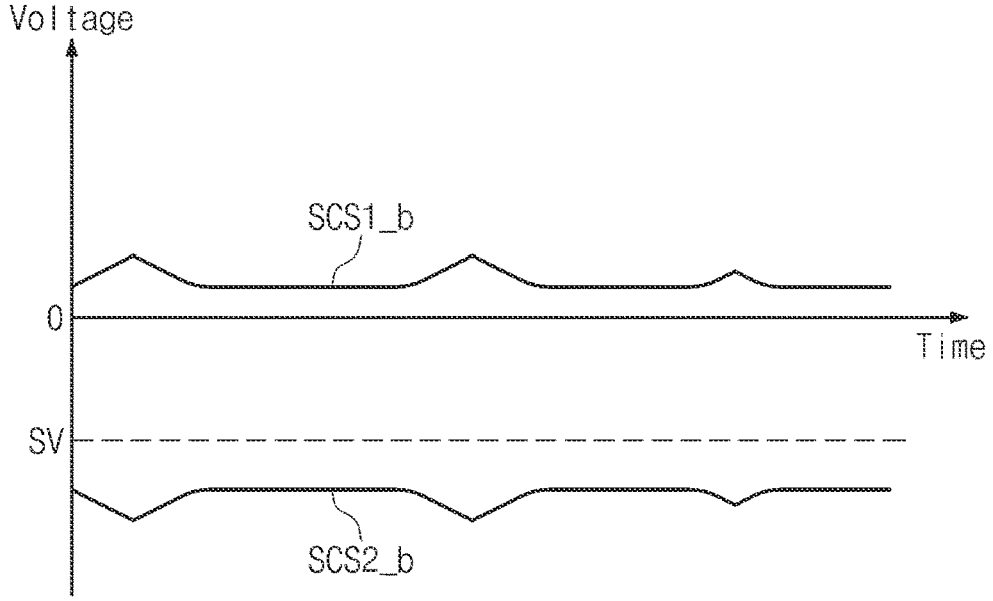
Figure 7C:
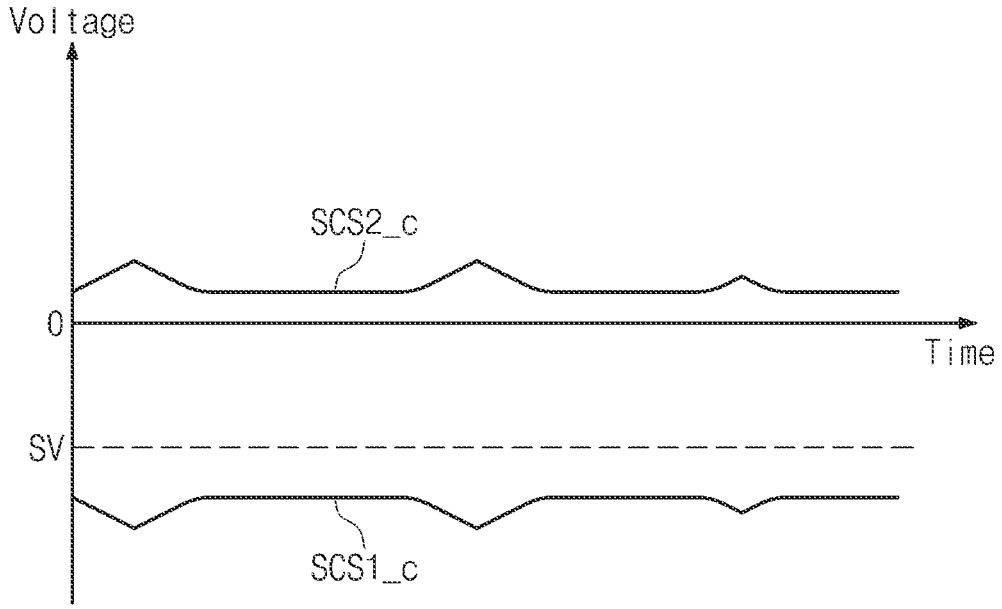

FIGS. 6A to 6C are block diagrams for explaining the structure of a circuit part of a control circuit board according to embodiments of the inventive concept. FIGS. 7A to 7C are graphs for explaining an operation of a comparison unit according to embodiments of the inventive concept.

Referring to FIG. 6A, the control circuit board CCB includes a comparison unit CSP, a first conversion unit CVU1, a second conversion unit CVU2, and a generation unit GNP.

As an example of the inventive concept, the comparison unit CSP receives the first feedback voltage FV1 and the second feedback voltage FV2. The comparison unit CSP compares the first feedback voltage FV1 and the second feedback voltage FV2 with a preset reference voltage RV, and generates a result signal CS_a in response to the comparison result. As an example of the inventive concept, the reference voltage RV may be a voltage having the same voltage level as the feedback voltage when the control circuit board CCB, the first connector CB1, the second connector CB2, the first source circuit board SCB1, and the second source circuit board SCB2 are all normally connected.

Specifically, the comparison unit CSP includes a first comparator CPT1 and a second comparator CPT2. As an example of the inventive concept, the first comparator CPT1 and the second comparator CPT2 may be operational amplifiers each including a + input terminal and a − input terminal. However, the embodiment of the embodiment of the inventive concept is not limited thereto, and the first comparator CPT1 and the second comparator CPT2 may include circuits capable of comparing the first and second feedback voltages FV1 and FV2 with the reference voltage RV. Hereinafter, for convenience of description, each of the first and second comparators CPT1 and CPT2 will be described as an operational amplifier.

As an example of the inventive concept, the result signal CS_a includes a first sub result signal SCS1 and a second sub result signal SCS2.

The first feedback voltage FV1 may be provided to the + input terminal of the first comparator CPT1 and the reference voltage RV may be provided to the − input terminal. The first comparator CPT1 generates a first sub result signal SCS1 by comparing the first feedback voltage FV1 with the reference voltage RV. Specifically, the first comparator CPT1 generates the first sub result signal SCS1 by comparing the magnitude of the first feedback voltage FV1 with the magnitude of the reference voltage RV. When the magnitude of the first feedback voltage FV1 is greater than the magnitude of the reference voltage RV, the first sub result signal SCS1 may have a first polarity (e.g., a positive polarity). When the magnitude of the first feedback voltage FV1 is smaller than the magnitude of the reference voltage RV, the first sub result signal SCS1 may have a second polarity (e.g., negative polarity) opposite to the first polarity.

The second feedback voltage FV2 may be provided to the + input terminal of the second comparator CPT2 and the reference voltage RV may be provided to the − input terminal of the second comparator CPT2. The second comparator CPT2 generates a second sub result signal SCS2 by comparing the second feedback voltage FV2 with the reference voltage RV. Specifically, the second comparator CPT2 generates the second sub result signal SCS2 by comparing the magnitude of the second feedback voltage FV2 with the magnitude of the reference voltage RV. When the magnitude of the second feedback voltage FV2 is greater than the magnitude of the reference voltage RV, the second sub result signal SCS2 has a first polarity (e.g., a positive polarity). When the magnitude of the second feedback voltage FV2 is smaller than the magnitude of the reference voltage RV, the second sub result signal SCS2 has a second polarity (e.g., a negative polarity) opposite to the first polarity.

As an example of the inventive concept, the magnitudes of the first sub result signal SCS1 and the second sub result signal SCS2 may be different according to a connection state between the control circuit board CCB, the first connector CB1, the second connector CB2, the first source circuit board SCB1, and the second source circuit board SCB2.

Referring to FIG. 7A, FIG. 7A is a graph representing a first sub result signal SCS1_*a* (hereinafter referred to as a first normal signal SCS1_*a*) when the control circuit board CCB, the first connector CB1, and the first source circuit board SCB1 are normally connected to each other and a second sub result signal SCS2_*a* (hereinafter referred to as a second normal signal SCS2_*a*) when the control circuit board CCB, the second connector CB2, and the second source circuit board SCB2 are normally connected to each other.

As an example of the inventive concept, the magnitudes of the first normal signal SCS1_*a* and the second normal signal SCS2_*a* are greater than the magnitudes of the first set value SV, which will be described later.

Also, although FIG. 7A shows that the polarity of the first normal signal SCS1_*a* and the polarity of the second normal signal SCS2_*a* are different from each other, the embodiment of the embodiment of the inventive concept is not limited thereto. As an example of the inventive concept, when the magnitude of the first feedback voltage FV1, the magnitude of the second feedback voltage FV2, and the magnitude of the reference voltage RV are all the same, both the first normal signal SCS1_*a* and the second normal signal SCS2_*a* may have a magnitude of zero.

Referring to FIG. 7B, FIG. 7B is a graph representing a first sub result signal SCS1_*b* (hereinafter referred to as a third normal signal SCS1_*b*) when the control circuit board CCB, the first connector CB1, and the first source circuit board SCB1 are normally connected to each other and a second sub result signal SCS2_*b* (hereinafter referred to as a first failure signal SCS2_*b*) when the connection state between the control circuit board CCB, the second connector CB2, and the second source circuit board SCB2 is bad.

As an example of the inventive concept, the magnitude of the third normal signal SCS1_*b* is greater than the magnitude of the first set value SV. However, the magnitude of the first failure signal SCS2_*b* is smaller than the magnitude of the first set value SV.

Also, although it is illustrated in FIG. 7B that the third normal signal SCS1_*b* is not 0 V, the embodiment of the embodiment of the inventive concept is not limited thereto. When the magnitude of the first feedback voltage FV1 and the magnitude of the reference voltage RV are the same, the third normal signal SCS1_*b* may have a magnitude of 0 V.

Referring to FIG. 7C, FIG. 7C is a graph representing a first sub result signal SCS1_*c* (hereinafter referred to as a second failure signal SCS1_*c*) when the connection state between the control circuit board CCB, the first connector CB1, and the first source circuit board SCB1 is bad and a second sub result signal SCS2_*c* (hereinafter referred to as a fourth normal signal SCS2_*c*) when the control circuit board CCB, the second connector CB2, and the second source circuit board SCB2 are normally connected to each other.

As an example of the inventive concept, the magnitude of the fourth normal signal SCS2_*c* is greater than the magnitude of the first set value SV. However, the magnitude of the second failure signal SCS1_*c* is smaller than the magnitude of the first set value SV.

In addition, although it is illustrated that the magnitude of the fourth normal signal SCS2_*c* is not 0 V in FIG. 7C, the embodiment of the embodiment of the inventive concept is not limited thereto. When the magnitude of the second feedback voltage FV2 and the magnitude of the reference voltage RV are the same, the fourth normal signal SCS2_*c* may have a magnitude of 0 V.

Referring to FIGS. 5, 6A, and 7A to 7C, the first conversion unit CVU1 receives the first sub result signal SCS1 from the first comparator CPT1. The first conversion unit CVU1 converts the first sub result signal SCS1 into a digital signal on the basis of the first set value SV included in the first set signal SVS to generate a first digital signal DTS1. When the magnitude of the first sub result signal SCS1 is greater than the first set value SV, the first digital signal DTS1 has a state of "0", and when the magnitude of the first sub result signal SCS1 is smaller than the first set value SV, the first digital signal DTS1 has a state of "1". When the first digital signal DTS1 has a state of "0", it may mean that the control circuit board CCB, the first connector CB1, and the first source circuit board SCB1 are normally connected. Conversely, when the first digital signal DTS1 has a state of "1", it may mean that the connection state between the control circuit board CCB, the first connector CB1, and the first source circuit board SCB1 is poor.

The second conversion unit CVU2 receives the second sub result signal SCS2 from the second comparator CPT2. The second conversion unit CVU2 converts the second sub result signal SCS2 into a digital signal based on the first set value SV included in the first set signal SVS to generate a second digital signal DTS2. When the magnitude of the second sub result signal SCS2 is greater than the first set value SV, the second digital signal DTS2 has a state of "0", and when the magnitude of the second sub result signal SCS2 is smaller than the first set value SV, the second digital signal DTS2 has a state of "1". When the second digital signal DTS2 has a state of "0", it may mean that the control circuit board CCB, the second connector CB2, and the second source circuit board SCB2 are normally connected. When the second digital signal DTS2 has a state of "0", it may mean that a connection state between the control circuit board CCB, the second connector CB2 and the second source circuit board SCB2 is poor.

Referring to FIGS. 6A and 8, the generation unit GNP generates a protection signal PS for activating a protection mode for protecting the display panel DP based on the result signal CS_a generated by the comparison unit CSP.

Specifically, the generation unit GNP generates a protection signal PS based on the first digital signal DTS1 received from the first conversion unit CVU1 and the second digital signal DTS2 received from the second conversion unit CVU2.

The generation unit GNP includes an arithmetic unit CCP for performing an exclusive OR operation on the first digital signal DTS1 and the second digital signal DTS2. The arithmetic unit CCP generates the determination signal DMS by performing an exclusive OR operation on the first digital signal DTS1 and the second digital signal DTS2. As an example of the inventive concept, the arithmetic unit CCP may receive the first digital signal DTS1 as the first input signal IP1 and the second digital signal DTS2 as the second input signal IP2. The arithmetic unit CCP generates the determination signal DMS as the output signal OP by performing an exclusive OR operation on the first input signal IP1 and the second input signal IP2. When the first and second digital signals DTS1 and DTS2 each have a state of "0", the arithmetic unit CCP generates a determination signal DMS having a state of "1". When the first digital signal DTS1 has a state of "0" and the second digital signal DTS2 has a state of "1", the arithmetic unit CCP generates a determination signal DMS having a state of "0". When the first digital signal DTS1 has a state of "1" and the second digital signal DTS2 has a state of "0", the arithmetic unit CCP generates a determination signal DMS having a state of "0". When the first digital signal DTS1 has a state of "1" and the second digital signal DTS2 has a state of "1", the arithmetic unit CCP generates a determination signal DMS having a state of "1". In this case, the generation unit GNP may output a determination signal DMS as a protection signal PS.

As an example of the inventive concept, when the protection signal PS has a state of "0", the display device DD (refer to FIG. 1) may operate in the protection mode. As an example of the inventive concept, the protection signal PS may be provided as a voltage generating block VGB (see FIG. 5). When a protection signal PS with a state of "0" is provided, the voltage generating block VGB may not provide the first and second driving voltages DV1 and DV2 to the first and second connection wires DVL1_*a* and DVL1_*b*. The display device DD may not provide the first and second driving voltages DV1 and DV2 to the display panel DP. Accordingly, when a connection state between the control circuit board CCB, the first connector CB1 and the first source circuit board SCB1 is poor, or a connection state between the control circuit board CCB, the second connector CB2, and the second source circuit board SCB2 is poor, it is possible to prevent damage to the display panel DP by flowing a current greater than the rated current to the display panel DP. Also, in the protection mode, the display device DD may not display the image IM (refer to FIG. 1) on the display panel DP (refer to FIG. 2). As an example of the inventive concept, it is determined based on the state of the protection signal PS that in the manufacturing process of the display device DD or the test stage after manufacturing the display device DD, a connection state between the control circuit board CCB, the first connector CB1, and the first source circuit board SCB1 is poor, or a connection state between the control circuit board CCB, the second connector CB2 and the second source circuit board SCB2 is poor, so that the connection state may be normalized. Accordingly, the efficiency of the display device DD manufacturing process may be increased.

As an example of the inventive concept, when the protection signal PS has a size of "1", the display device DD may normally display the image IM. At this time, even when a connection state between the control circuit board CCB, the first connector CB1, and the first source circuit board SCB1 and a connection state between the control circuit board CCB, the second connector CB2, and the second source circuit board SCB2 are all bad, the protection signal PS has a size of "1". But, in this case, since the first and second driving voltages DV1 and DV2 lower than the first power supply voltage ELVDD are respectively applied to the first and second source circuit boards SCB1 and SCB2, the display device DD does not operate normally and cannot display an image on the display panel DP.

Referring to FIG. 6B, the generation unit GNP_a may further include a counter unit CTP. Hereinafter, the same reference numerals are assigned to the same components as those described with reference to FIG. 2, and descriptions thereof will be omitted.

The counter unit CTP receives a determination signal DMS from the arithmetic unit CCP, and receives a section signal PDS and a count signal CTS from the outside. As an example of the inventive concept, the section signal PDS may be a signal including information on a preset section serving as a count reference of the counter unit CTP. As an example of the inventive concept, the length of the section included in the section signal PDS may be determined corresponding to the driving frequency of the display panel DP. As an example of the inventive concept, the count signal CTS may include information about a preset number. The counter unit CTP may count the number when the state of the determination signal DMS is "1". The counter unit CTP may determine whether the counted number is equal to or greater than a preset number included in the count signal CTS when the state of the determination signal DMS is "1" within one section included in the section signal PDS. The counter unit CTP generates a protection signal PS_a having a state of "0" when the number counted when the status of the determination signal DMS is "1" is greater than or equal to the preset number included in the count signal CTS. The counter unit CTP generates a protection signal PS_a having a state of "1" when the number counted when the status of the determination signal DMS is "1" is smaller than the preset number included in the count signal CTS.

The display device DD operates in a protection mode when the counter unit CTP determines that the counted number when the state of the determination signal DMS is "1" is equal to or greater than the preset number included in the count signal CTS. Accordingly, when the first and second comparators CPT1 and CPT2 or the first and second conversion units CVU1 and CVU2 malfunction, it is possible to prevent the display device DD from operating in the protection mode.

Referring to FIG. 6C, the control circuit board CCB may further include a first flip-flop FF1 and a second flip-flop FF2. Hereinafter, the same reference numerals are assigned to the same components and signals as those described in FIGS. 6A and 6B, and descriptions thereof will be omitted.

The first flip-flop FF1 may receive the first digital signal DTS1 from the first conversion unit CVU1, and generate the first corrected digital signal CDTS1 by sampling the first digital signal DTS1 according to the externally provided clock signal CLK. The second flip-flop FF2 may receive the second digital signal DTS2 from the second conversion unit CVU2, and generate the second corrected digital signal CDTS2 by sampling the second digital signal DTS2 according to the externally provided clock signal CLK.

As an example of the inventive concept, the clock signal CLK may be a signal synchronized with the operation frame of the display panel DP (refer to FIG. 2). As an example of the inventive concept, the first and second flip-flops FF1 and FF2 may sample the first and second digital signals DTS1 and DTS2 when the clock signal CLK has a rising edge or a falling edge, respectively, to generate the first and second corrected digital signals CDTS1 and CDTS2. Through this, even if the control circuit board CCB, the first connector CB1, the second connector CB2, the first source circuit board SCB1, and the second source circuit board SCB2 are normally connected, as the first or second power supply voltage ELVDD or ELVSS (see FIG. 3) is changed while the display panel DP is being driven, it is possible to prevent the display panel DP from erroneously operating in the protection mode.

The arithmetic unit CCP performs an exclusive OR operation on the first corrected digital signal CDTS1 received from the first flip-flop FF1 and the second corrected digital signal CDTS2 received from the second flip-flop FF2 to generate a determination signal DMS_a.

The counter unit CTP generates a protection signal PS_b based on the section signal PDS, the count signal CTS, and the determination signal DMS_a.

Figure 9A:
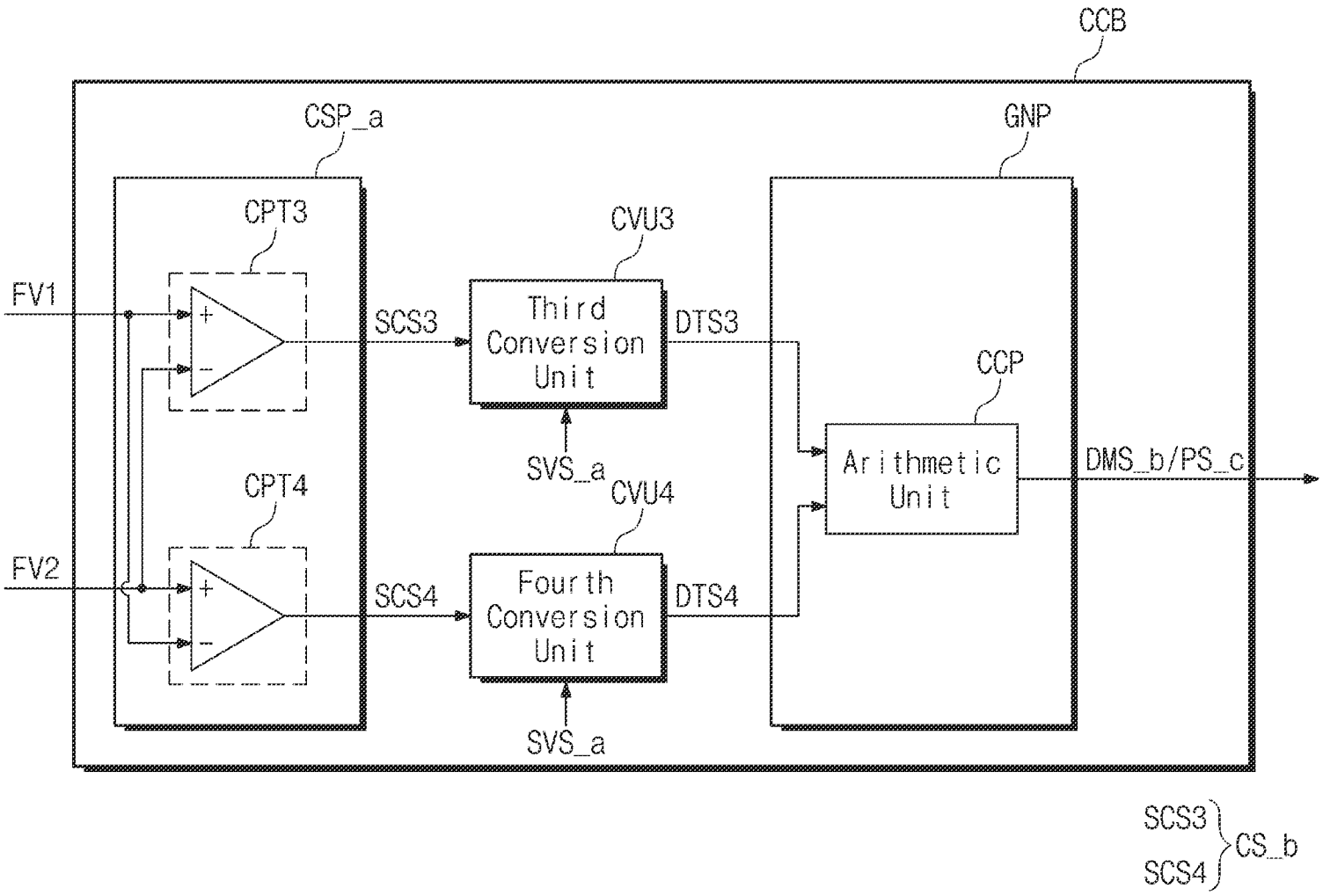
FIGS. 9A and 9B are block diagrams for explaining the structure of a circuit part of a control circuit board according to embodiments of the inventive concept.
Figure 9B:
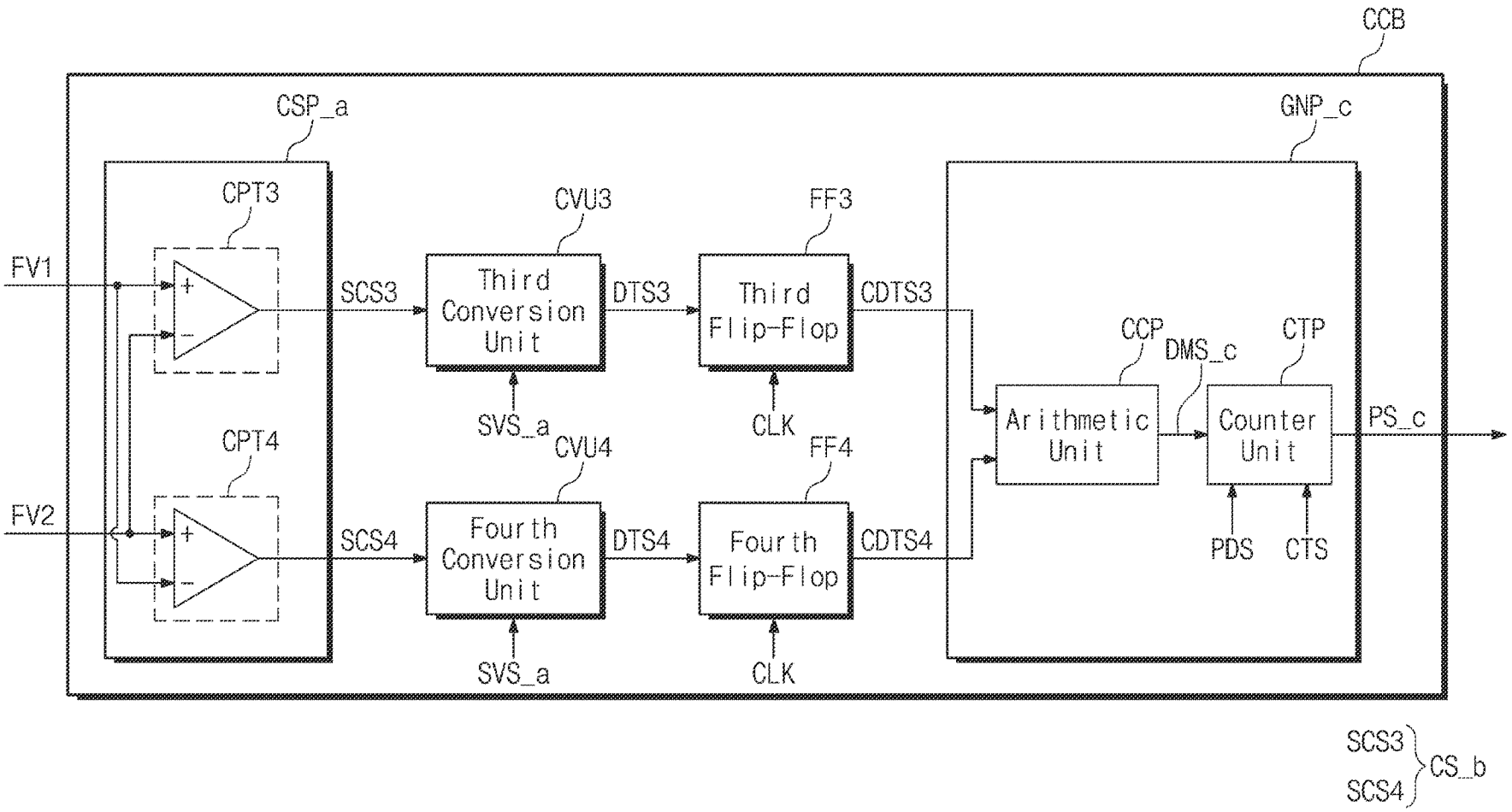
Figure 10A:
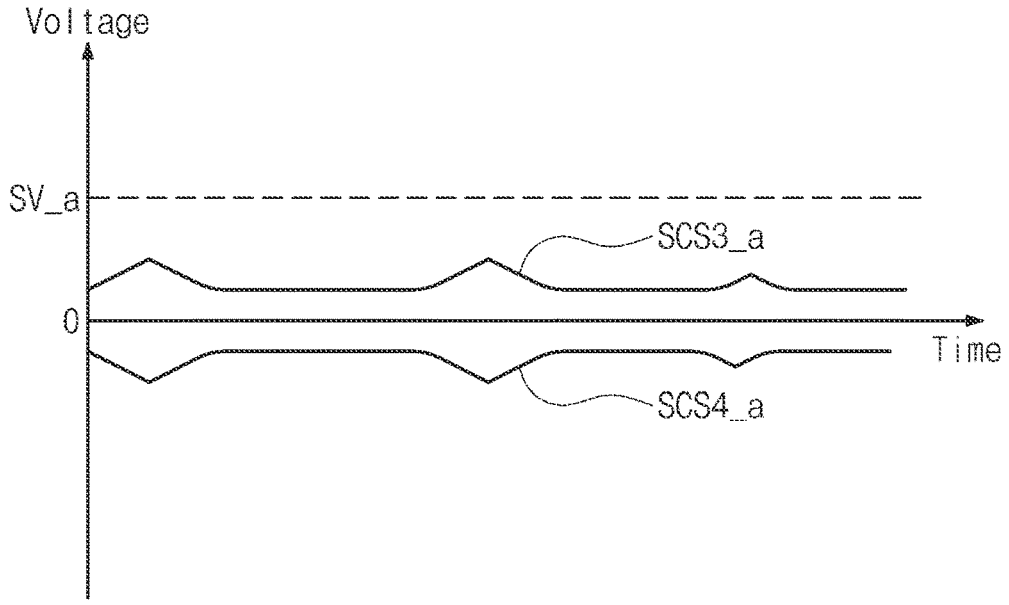
FIGS. 10A, 10B, and 10C are graphs for explaining an operation of a comparison unit according to embodiments of the inventive concept.
Figure 10B:
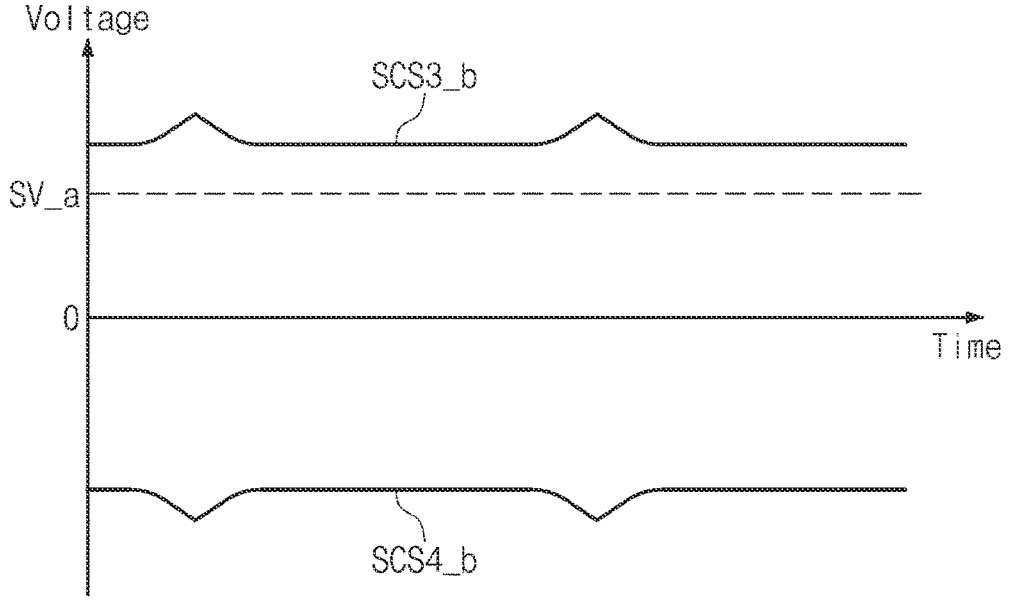
Figure 10C:
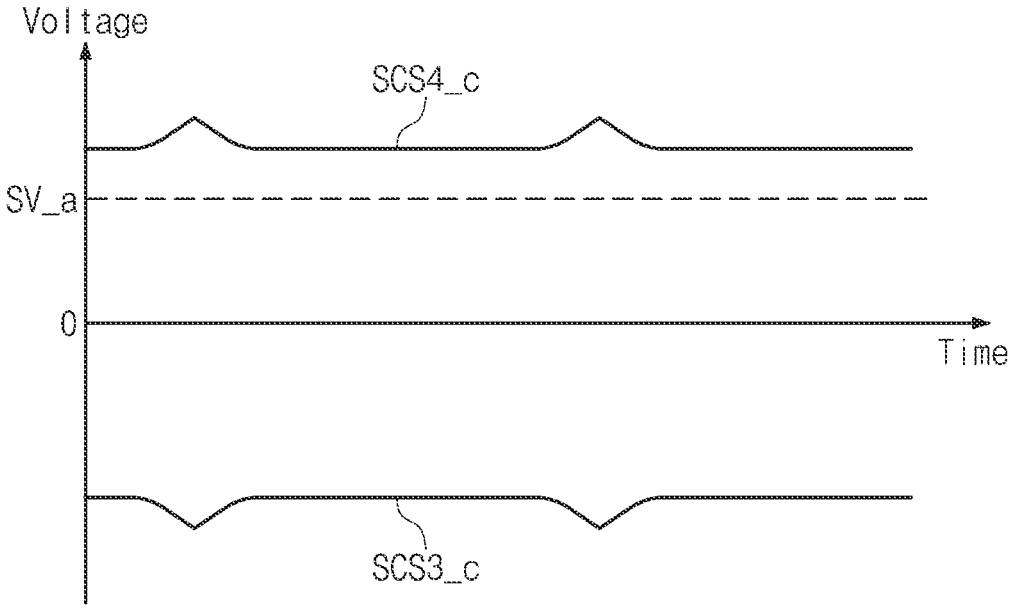

FIGS. 9A and 9B are block diagrams for explaining the structure of a circuit part of a control circuit board according to embodiments of the inventive concept. FIGS. 10A to 10C are graphs for explaining an operation of a comparison unit according to embodiments of the inventive concept.

Referring to FIG. 9A, the control circuit board CCB includes a comparison unit CSP_a, a third conversion unit CVU3, a fourth conversion unit CVU4, and a generation unit GNP. Hereinafter, the same reference numerals are assigned to the same components and signals as those described with reference to FIG. 6A, and descriptions thereof will be omitted.

The comparison unit CSP_a receives the first feedback voltage FV1 and the second feedback voltage FV2. The comparison unit CSP_a compares the first feedback voltage FV1 and the second feedback voltage FV2 with each other, and generates a result signal CS_b in response to the comparison result. Although FIG. 9A illustrates that the comparison unit CSP_a receives the first and second feedback voltages FV1 and FV2, the embodiment of the embodiment of the inventive concept is not limited thereto. When three or more source circuit boards are included in the display device DD (see FIG. 2), and each of the source circuit boards outputs feedback voltages to the comparison unit CSP_a, the comparison unit CSP_a may receive three or more feedback voltages. In this case, the comparison unit CSP_a may generate a result signal by comparing each of three or more feedback voltages with each other. Hereinafter, for convenience of explanation, it is described that the comparison unit CSP_a receives the first and second feedback voltages FV1 and FV2 and compares the first and second feedback voltages FV1 and FV2 with each other to generate a result signal CS_b.

As an example of the inventive concept, the comparison unit CSP includes a third comparator CPT3 and a fourth comparator CPT4. As an example of the inventive concept, the third comparator CPT3 and the fourth comparator CPT4 may be operational amplifiers each including a + input terminal and a − input terminal. However, the embodiment of the embodiment of the inventive concept is not limited thereto, and the third comparator CPT3 and the fourth comparator CPT4 may include circuits capable of performing a function of comparing each of the first and second feedback voltages FV1 and FV2. Hereinafter, for convenience of description, each of the third and fourth comparators CPT3 and CPT4 will be described as an operational amplifier.

As an example of the inventive concept, the result signal CS_b includes a third sub result signal SCS3 and a fourth sub result signal SCS4.

The first feedback voltage FV1 may be provided to the + input terminal of the third comparator CPT3 and the second feedback voltage FV2 may be provided to the − input terminal. The third comparator CPT3 compares the first feedback voltage FV1 with the second feedback voltage FV2 to generate a third sub result signal SCS3. Specifically, the third comparator CPT3 compares the magnitude of the first feedback voltage FV1 with the magnitude of the second feedback voltage FV2 to generate the third sub result signal SCS3. When the magnitude of the first feedback voltage FV1 is greater than the magnitude of the second feedback voltage FV2, the third sub result signal SCS3 may have a first polarity (e.g., a positive polarity). When the magnitude of the first feedback voltage FV1 is smaller than the magnitude of the second feedback voltage FV2, the third sub result signal SCS3 may have a second polarity (e.g., a negative polarity) opposite to the first polarity.

The second feedback voltage FV2 may be provided to the + input terminal of the fourth comparator CPT4 and the first feedback voltage FV1 may be provided to the − input terminal. The fourth comparator CPT4 generates a fourth sub result signal SCS4 by comparing the second feedback voltage FV2 with the first feedback voltage FV1. Specifically, the second comparator CPT2 generates the fourth sub result signal SCS4 by comparing the magnitude of the second feedback voltage FV2 with the magnitude of the first feedback voltage FV1. When the magnitude of the second feedback voltage FV2 is greater than the magnitude of the first feedback voltage FV1, the fourth sub result signal SCS4 has a first polarity (e.g., a positive polarity). When the magnitude of the second feedback voltage FV2 is smaller than the magnitude of the first feedback voltage FV1, the fourth sub result signal SCS4 has a second polarity opposite to the first polarity (e.g., negative polarity). As an example of the inventive concept, compared to the case where the first and second comparators CPT1 and CPT2 shown in FIG. 7A compare the first and second feedback voltages FV1 and FV2 respectively with the reference voltage RV to generate the result signal CS_a, the third and fourth comparators CPT3 and CPT4 illustrated in FIG. 9A compare the third and fourth feedback voltages FV3 and FV4 with each other to generate a result signal CS_b. Through this, even if the control circuit board CCB, the first connector CB1, the second connector CB2, the first source circuit board SCB1, and the second source circuit board SCB2 are normally connected, as the first or second power supply voltage ELVDD or ELVSS (see FIG. 3) is changed while the display panel DP is being driven, it is possible to prevent the display panel DP from erroneously operating in the protection mode.

As an example of the inventive concept, the magnitudes of the third sub result signal SCS3 and the fourth sub result signal SCS4 may be different according to a connection state between the control circuit board CCB, the first connector CB1, the second connector CB2, the first source circuit board SCB1, and the second source circuit board SCB2.

Referring to FIG. 10A, FIG. 10A is a graph representing a third sub result signal SCS3_*a* (hereinafter referred to as a fifth normal signal SCS3_*a*) and a fourth sub result signal SCS4_*a* (hereinafter referred to as a sixth normal signal SCS4_*a*) when the control circuit board CCB, the first connector CB1, and the first source circuit board SCB1 are normally connected to each other, and the control circuit board CCB, the second connector CB2, and the second source circuit board SCB2 are normally connected to each other.

As an example of the inventive concept, the magnitudes of the fifth normal signal SCS3_*a* and the sixth normal signal SCS4_*a* are smaller than the magnitudes of the second set value SV_a, which will be described later.

Also, although FIG. 10A shows that the polarity of the fifth normal signal SCS3_*a* and the polarity of the sixth normal signal SCS4_*a* are different from each other, the embodiment of the inventive concept is not limited thereto. As an example of the inventive concept, when the magnitude of the first feedback voltage FV1 and the magnitude of the second feedback voltage FV2 are the same, both the fifth normal signal SCS3_*a* and the sixth normal signal SCS4_*a* may have a magnitude of 0 V.

Referring to FIG. 10B, FIG. 10B is a graph representing a third sub result signal SCS3_*b* (hereinafter referred to as a third failure signal SCS3_*b*) and a fourth sub result signal SCS4_*b* (hereinafter referred to as a fourth failure signal SCS4_*b*) when the control circuit board CCB, the first connector CB1, and the first source circuit board SCB1 are normally connected to each other, and the connection state between the control circuit board CCB, the second connector CB2, and the second source circuit board SCB2 is bad.

As an example of the inventive concept, the magnitude of the third failure signal SCS3_*b* is greater than the second set value SV_a. However, the magnitude of the fourth failure signal SCS4_*b* is smaller than the second set value SV_a.

Referring to FIG. 10C, FIG. 10C is a graph representing a third sub result signal SCS3_*c* (hereinafter referred to as a fifth failure signal SCS3_*c*) and a fourth sub result signal SCS4_*c* (hereinafter referred to as a sixth failure signal SCS4_*c*) when a connection state between the control circuit board CCB, the first connector CB1 and the first source circuit board SCB1 is poor, and the control circuit board CCB, the second connector CB2, and the second source circuit board SCB2 are normally connected.

As an example of the inventive concept, the magnitude of the fifth failure signal SCS3_*c* is smaller than the magnitude of the second set value SV_a. However, the magnitude of the sixth failure signal SCS4_*c* is greater than the magnitude of the second set value SV_a.

FIGS. 9A and 10A to 10C, the third conversion unit CVU3 receives the third sub result signal SCS3 from the third comparator CPT3. The third conversion unit CVU3 converts the third sub result signal SCS3 into a digital signal on the basis of the second set value SV_a included in the second set signal SVS_a to generate a third digital signal DTS3. When the magnitude of the third sub result signal SCS3 is greater than the second set value SV_a, the third digital signal DTS3 has a state of "1", and when the magnitude of the third sub result signal SCS3 is smaller than the second set value SV_a, the third digital signal DTS3 has a state of "0". When the third digital signal DTS3 has a state of "0", it may mean that the control circuit board CCB, the first connector CB1, and the first source circuit board SCB1 are normally connected. Conversely, when the third digital signal DTS3 has a state of "3", it may mean that the connection state between the control circuit board CCB, the first connector CB1, and the first source circuit board SCB1 is poor.

The fourth conversion unit CVU4 receives the fourth sub result signal SCS4 from the fourth comparator CPT4. The fourth conversion unit CVU4 converts the fourth sub result signal SCS4 into a digital signal on the basis of the first set value SV_a included in the second set signal SVS_a to generate a fourth digital signal DTS4. When the magnitude of the fourth sub result signal SCS4 is greater than the second set value SV_a, the fourth digital signal DTS4 has a state of "1", and when the magnitude of the fourth sub result signal SCS4 is smaller than the second set value SV_a, the fourth digital signal DTS4 has a state of "0". When the fourth digital signal DTS4 has a state of "0", it may mean that the control circuit board CCB, the second connector CB2, and the second source circuit board SCB2 are normally connected. When the second digital signal DTS2 has a state of "1", it may mean that a connection state between the control circuit board CCB, the second connector CB2 and the second source circuit board SCB2 is poor.

The generation unit GNP generates a protection signal PS_c that activates a protection mode for protecting the display panel DP based on the result signal CS_b generated by the comparison unit CSP_a.

Specifically, the generation unit GNP generates a protection signal PS_c based on the third digital signal DTS3 received from the third conversion unit CVU3 and the fourth digital signal DTS4 received from the fourth conversion unit CVU4.

The generation unit GNP includes an arithmetic unit CCP that performs an exclusive OR operation on the third digital signal DTS3 and the fourth digital signal DTS4. The arithmetic unit CCP generates a determination signal DMS_b by performing an exclusive OR operation on the third digital signal DTS3 and the fourth digital signal DTS4. In this case, the generation unit GNP may output a determination signal DMS_b as a protection signal PS_c.

Referring to FIG. 9B, the control circuit board CCB may further include a third flip-flop FF3 and a fourth flip-flop FF4. The generation unit GNP_c may further include a counter unit CTP. Hereinafter, the same reference numerals are assigned to the same components and signals as those of the components and signals described with reference to FIGS. 6A to 6C, and descriptions thereof will be omitted.

The third flip-flop FF3 may receive the third digital signal DTS3 from the third conversion unit CVU3 and generate a third corrected digital signal CDTS3 by sampling the third digital signal DTS3 according to the externally provided clock signal CLK. The fourth flip-flop FF4 may receive the fourth digital signal DTS4 from the fourth conversion unit CVU4 and generate a fourth corrected digital signal CDTS4 by sampling the fourth digital signal DTS4 according to the externally provided clock signal CLK.

The arithmetic unit CCP performs an exclusive OR operation on the third corrected digital signal CDTS3 received from the third flip-flop FF3 and the fourth corrected digital signal CDTS4 received from the fourth flip-flop FF4 to generate a determination signal DMS_c.

The counter unit CTP generates a protection signal PS_c based on the section signal PDS, the count signal CTS, and the determination signal DMS_c.

According to the inventive concept, the display device may check whether a driving voltage for driving the display panel is stably supplied to the display panel. The display device displays an image on the display panel when the driving voltage is stably supplied to the display panel, and does not display the image on the display panel when the driving voltage is unstablely supplied to the display panel. Accordingly, even when a driving voltage is unstablely supplied to the display device, an image is displayed on the display panel, thereby preventing the display panel from being damaged.

Although embodiments of the inventive concept have been described, it is understood that the inventive concept should not be limited to these embodiments but various changes and modifications may be made by one of ordinary skill in the art within the spirit and scope of the appended claims.

What is claimed is:

1. A display device comprising:

a display panel including a plurality of pixels for displaying an image;

a first source circuit board configured to receive a first driving voltage, supply the first driving voltage to the display panel, and output a first feedback voltage corresponding to the first driving voltage;

a second source circuit board configured to receive a second driving voltage, supply the second driving voltage to the display panel, and output a second feedback voltage corresponding to the second driving voltage; and a control circuit board configured to supply the first and second driving voltages to the first and second source circuit boards, respectively, and receive the first and second feedback voltages from the first and second source circuit boards, respectively, wherein the control circuit board comprises:

a comparison unit configured to compare the first and second feedback voltages with a preset reference voltage and generate a result signal in response to a comparison result; and a generation unit configured to generate a protection signal for activating a protection mode for protecting the display panel based on the result signal.

2. The display device of claim 1, wherein the result signal comprises a first sub result signal and a second sub result signal, wherein the comparison unit comprises:

a first comparator configured to generate the first sub result signal by comparing the first feedback voltage with the reference voltage; and a second comparator configured to generate the second sub result signal by comparing the second feedback voltage with the reference voltage.

3. The display device of claim 2, wherein the first comparator generates the first sub result signal by comparing the magnitude of the first feedback voltage with the magnitude of the reference voltage, and when the magnitude of the first feedback voltage is greater than the magnitude of the reference voltage, the first sub result signal has a first polarity, and when the magnitude of the first feedback voltage is smaller than the magnitude of the reference voltage, the first sub result signal has a second polarity opposite to the first polarity, wherein the second comparator generates the second sub result signal by comparing the magnitude of the second feedback voltage with the magnitude of the reference voltage, and when the magnitude of the second feedback voltage is greater than the magnitude of the reference voltage, the second sub result signal has the first polarity, and when the magnitude of the second feedback voltage is smaller than the magnitude of the reference voltage, the second sub result signal has the second polarity.

4. The display device of claim 3, wherein the control circuit board further comprises:

a first conversion unit configured to convert the first sub result signal into a first digital signal; and a second conversion unit configured to convert the second sub result signal to a second digital signal.

5. The display device of claim 4, wherein the generation unit comprises an arithmetic unit for generating a determination signal by performing an exclusive OR operation on the first digital signal received from the first conversion unit and the second digital signal received from the second conversion unit, wherein the generation unit generates the protection signal based on the determination signal.

6. The display device of claim 5, wherein the control circuit board further comprises:

a first flip-flop configured to receive the first digital signal from the first conversion unit and generate a first corrected digital signal by sampling the first digital signal according to a clock signal synchronized with an operation frame of the display panel; and a second flip-flop configured to receive the second digital signal from the second conversion unit and generate a second corrected digital signal by sampling the second digital signal according to the clock signal.

7. The display device of claim 6, wherein the arithmetic unit performs an exclusive OR operation on the first corrected digital signal received from the first flip-flop and the second corrected digital signal received from the second flip-flop to generate the determination signal.

8. The display device of claim 5, wherein the generation unit further comprises a counter unit for receiving the determination signal from the arithmetic unit and receiving a section signal including information on a preset section from the outside and a count signal including information on a preset number, wherein the counter unit generates the protection signal based on the determination signal, the section signal, and the count signal.

9. The display device of claim 1, wherein the control circuit board is electrically connected to the first source circuit board through a first connector, and electrically connected to the second source circuit board through a second connector.

10. The display device of claim 9, wherein the first source circuit board receives the first driving voltage through a first driving voltage wire, and provides the first feedback voltage to the control circuit board through a first feedback voltage wire connected to the first driving voltage wire, wherein the second source circuit board receives the second driving voltage through a second driving voltage wire, and provides the second feedback voltage to the control circuit board through a second feedback voltage wire connected to the second driving voltage wire.

11. The display device of claim 10, wherein the first connector comprises a first transmission wire electrically connected to the first driving voltage wire and a first reception wire electrically connected to the first feedback voltage wire, and the second connector comprises a second transmission wire electrically connected to the second driving voltage wire and a second reception wire electrically connected to the second feedback voltage wire, wherein the control circuit board provides the first driving voltage to the first source circuit board through the first transmission wire and receives the first feedback voltage through the first reception wire, and provides the second driving voltage to the second source circuit board through the second transmission wire and receives the second feedback voltage through the second reception wire.

12. The display device of claim 1, wherein each of the pixels comprises:

a light emitting device; and a pixel driving circuit configured to control an operation of the light emitting device based on a first power supply voltage and a second power supply voltage, wherein the control circuit board supplies the first and second power supply voltages to the pixel driving circuit.

13. The display device of claim 12, wherein each of the first and second driving voltages is the first power supply voltage.

14. The display device of claim 12, wherein each of the first and second driving voltages is the second power supply voltage.

15. The display device of claim 1, wherein in the protection mode, the image is not displayed on the display panel.

16. The display device of claim 1, wherein in the protection mode, the first and second driving voltages are not provided to the display panel.

17. The display device of claim 1, wherein the control circuit board further comprises a voltage generating block for generating the first driving voltage and the second driving voltage.

18. A display device comprising:

a display panel including a plurality of pixels for displaying an image;

a plurality of source circuit boards configured to respectively provide a plurality of driving voltages to the display panel, and respectively output a plurality of feedback voltages corresponding to the respective driving voltages; and a control circuit board configured to respectively supply the driving voltages to the source circuit boards and respectively receive the feedback voltages from the source circuit boards, wherein the control circuit board comprises:

a comparison unit configured to compare two feedback voltages among the feedback voltages with each other and generate a result signal in response to a comparison result; and a generation unit configured to generate a protection signal for activating a protection mode for protecting the display panel based on the result signal.

19. The display device of claim 18, wherein the result signal comprises a first sub result signal and a second sub result signal, wherein the comparison unit comprises:

a first comparator configured to generate the first sub result signal by comparing a magnitude of a first feedback voltage that is one of the two feedback voltages and a magnitude of a second feedback voltage that is the other one; and a second comparator configured to generate the second sub result signal, wherein the first comparator generates the first sub result signal to have a first polarity when the magnitude of the first feedback voltage is greater than the magnitude of the second feedback voltage, and generates the first sub result signal to have a second polarity opposite to the first polarity when the magnitude of the first feedback voltage is smaller than the magnitude of the second feedback voltage, wherein the second comparator generates the second sub result signal to have a second polarity when the magnitude of the first feedback voltage is greater than the magnitude of the second feedback voltage, and generates the second sub result signal to have the first polarity when the magnitude of the first feedback voltage is smaller than the magnitude of the second feedback voltage.

20. The display device of claim 19, wherein the control circuit board further comprises:

a first conversion unit configured to convert the first sub result signal into a first digital signal; and a second conversion unit configured to convert the second sub result signal into a second digital signal.

21. The display device of claim 20, wherein the generation unit comprises an arithmetic unit for generating a determination signal by performing an exclusive OR operation on the first digital signal received from the first conversion unit and the second digital signal received from the second conversion unit, wherein the generation unit generates the protection signal based on the determination signal.

22. The display device of claim 21, wherein the control circuit board further comprises:

a first flip-flop configured to receive the first digital signal from the first conversion unit and generate a first corrected digital signal by sampling the first digital signal according to a clock signal synchronized with an operation frame of the display panel; and a second flip-flop configured to receive the second digital signal from the second conversion unit and generate a second corrected digital signal by sampling the second digital signal according to the clock signal.

23. The display device of claim 22, wherein the arithmetic unit performs an exclusive OR operation on the first corrected digital signal received from the first flip-flop and the second corrected digital signal received from the second flip-flop to generate the determination signal.

24. The display device of claim 21, wherein the generation unit further comprises a counter unit for receiving the determination signal from the arithmetic unit and receiving a section signal including information on a preset section from the outside and a count signal including information on a preset number, wherein the counter unit generates the protection signal based on the determination signal, the section signal, and the count signal.

* * * * *